US012385392B2

(12) United States Patent
Meza Camargo et al.

(10) Patent No.: US 12,385,392 B2
(45) Date of Patent: Aug. 12, 2025

(54) DETERMINING A THREE-DIMENSIONAL FRACABILITY INDEX FOR IDENTIFYING FRACABLE AREAS IN A SUBSURFACE REGION

(71) Applicant: Saudi Arabian Oil Company, Dhahran (SA)

(72) Inventors: Otto E. Meza Camargo, Dhahran (SA); Rakan Alkheliwi, Dhahran (SA); Waheed Syed Arshad, Mississauga (CA); Ivan Deshenenkov, Dhahran (SA); Karla Olvera, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 394 days.

(21) Appl. No.: 17/950,803

(22) Filed: Sep. 22, 2022

(65) Prior Publication Data

US 2024/0102384 A1 Mar. 28, 2024

(51) Int. Cl.
*E21B 49/00* (2006.01)
*E21B 47/12* (2012.01)

(52) U.S. Cl.
CPC ..... *E21B 49/003* (2013.01); *E21B 47/12* (2013.01); *E21B 2200/20* (2020.05); *E21B 2200/22* (2020.05)

(58) Field of Classification Search
None
See application file for complete search history.

(56) References Cited

U.S. PATENT DOCUMENTS

| | | | |
|---|---|---|---|
| 9,062,545 | B2 | 6/2015 | Roberts et al. |
| 10,001,003 | B2 | 6/2018 | Dusseault et al. |
| 10,572,829 | B1 | 2/2020 | Willinger |
| 11,073,006 | B2 | 7/2021 | Hoeink et al. |

(Continued)

FOREIGN PATENT DOCUMENTS

| | | |
|---|---|---|
| CN | 109523531 | 3/2019 |
| CN | 112698392 | 4/2021 |

(Continued)

OTHER PUBLICATIONS arcgis.com [online], "How kernel density works," 2019, retrieved on Mar. 23. 2023, retrieved from URL <http://desktop.arcgis.com/en/arcmap/10.6/tools/spatial-analyst-toolbox/how-kernel-density-works.htm>, 3 pages.

(Continued)

*Primary Examiner* — Walter L Lindsay, Jr.
*Assistant Examiner* — Geoffrey T Evans
(74) *Attorney, Agent, or Firm* — Fish & Richardson P.C.

(57) ABSTRACT

Systems, methods, and software can be used for identifying fracable areas. One example of a method includes receiving at least one of 3D petrophysical property and 3D geo-mechanical property in one or more areas. The method further includes receiving a model generating at least one hydraulic fracture parameter in a wellbore in the one or more areas. The method yet further includes training a machine learning model with at least one of the 3D petrophysical property and the 3D geo-mechanical property and the at least one hydraulic fracture parameter, and generating a fracability index for the wellbore based on the trained machine learning model.

17 Claims, 22 Drawing Sheets

(56) References Cited

U.S. PATENT DOCUMENTS

| | | | | |
|---|---|---|---|---|
| 11,098,582 | B1 | 8/2021 | Camargo et al. | |
| 11,921,250 | B2 * | 3/2024 | Camargo | G01V 1/50 |
| 2017/0306750 | A1 * | 10/2017 | Carpenter | G01V 3/00 |
| 2019/0057168 | A1 * | 2/2019 | Holland | G01V 20/00 |

FOREIGN PATENT DOCUMENTS

| | | |
|---|---|---|
| CN | 112698393 | 4/2021 |
| CN | 113111582 | 7/2021 |
| CN | 113687424 | 11/2021 |
| CN | 114021466 | 2/2022 |
| CN | 114033352 | 2/2022 |
| RU | 2404359 | 1/2010 |
| WO | WO 2021064585 | 4/2021 |

OTHER PUBLICATIONS

Barree et al., "Holistic Fracture Diagnostics," Rocky Mountain Oil & Gas Technology Symposium, Apr. 2007, 13 pages.

Camargo et al., "Reservoir Stress Path from 4D Coupled High Resolution Geomechanics Model: A Case Study for Jauf Formation, North Ghawar, Saudi Arabia," The Saudi Aramco Journal of Technology, Fall 2016, 45-60, 75 pages.

Mojeddifar et al., "Porosity prediction seismic inversion of a similarity attribute based on a pseudo-forward equation (PFE): a case study from the North Sea Basin, Netherlands," Petroleum Science, Aug. 2015, 12(3):428-442, 15 pages.

Ochie et al., "Geostatistics—Kriging and Co-Kriging Methods in Reservoir Characterization of Hydrocarbon Rock Deposits," SPE Nigeria Annual International Conference and Exhibition, Aug. 2018, 11 pages.

* cited by examiner

600

DETERMINING A THREE-DIMENSIONAL FRACABILITY INDEX FOR IDENTIFYING FRACABLE AREAS IN A SUBSURFACE REGION

FIELD OF THE INVENTION

This document relates applies to a field of developing models for identifying fracable areas in a subsurface region. Specifically, this document describes methods and systems for executing a model that identifies fracable areas in naturally fractured reservoirs.

BACKGROUND

Identifying areas to plan new wells for hydraulic fracture stimulation in tight-sand, naturally fractured reservoirs challenging. Existing methodologies can rely on net-pay models or rock quality sand maps to plan new wells for stimulation. Net-pay models determine a number of meters of net sand that has movable oil in it.

SUMMARY

This specification describes systems and methods for modeling a fracability index within a three-dimensional (3D) grid reservoir model. The method includes developing a regression model that identifies fracable areas in a subsurface region. The model can include a machine learning model that combines responses of three major geological elements. These elements include 3D petrophysical properties, 3D geo-mechanical properties, and a fracture model. The fracture model includes a fitness function. The fitness function is tuned by adjustment, of hydraulic fracture parameters such as fracture closure pressure (FCP), injection rate, and so forth. Based on the 3D petrophysical properties, the 3D geo-mechanical properties, and the fracture model, a supervised machine learning model predicts FCP from existing hydraulic fractured wells. The data processing system can perform a calibration between the well logs and mechanical test data. A data processing system, based on the calibration, generates a 3D mechanical earth model and updates the fracture model. The data processing system, based on this calibration, determines an area with a favorable fracability index value, prior to drilling. The machine learning model enables improved well placement and field development for a region.

The subject matter described in this specification can be implemented in particular implementations, so as to realize one or more of the following advantages. During exploration of a subsurface region, wells can be drilled in relatively favorable locations in the region, relative to other regions in the region. The wells are drilled in areas that enable a higher production or that are more likely to have a higher production of hydrocarbons. This reduces production costs and increases overall productivity in a region. In some implementations, a coefficient of determination is about 99%. This value demonstrates a low variation in the prediction results of the machine learning model.

One or more of the following aspects enable one or more of the previously described advantages.

In an aspect, a computer-implemented process for identifying fracable areas of a subsurface region including an unfractured wellbore includes the following. The process includes receiving data comprising a first value representing a three-dimensional (3D) petrophysical property for a given subsurface region including a fractured wellbore, a second value representing a 3D geo-mechanical property for the given subsurface region including the fractured wellbore, or both the first value and the second value. The process includes receiving a geological model that includes a value for at least one hydraulic fracture parameter that is associated with the fractured wellbore in the subsurface region. The process includes training a machine learning model with at least one of the first value and the second value and with the value of at the least one hydraulic fracture parameter. The process includes applying the machine learning model to data representing the at least one of the 3D petrophysical property and the 3D geo-mechanical property and the at least one hydraulic fracture parameter for the subsurface region comprising an unfractured wellbore. The process includes generating a fracability index for the unfractured wellbore based on the trained machine learning model. The process includes based on the fracability index, fracturing the unfractured wellbore.

In some implementations, the process includes receiving a fluid-flow path model, wherein the fluid-flow path model is constructed based on a fracture density index (FDI) of the wellbore. The process includes generating a fracture closure pressure (FCP) for the wellbore based on the trained machine learning model.

In some implementations, the process includes validating the fracability index for the wellbore generated by the trained machine model with an original fracability index, wherein the original fracability is generated based on at least one of the 3D petrophysical property and the 3D geo-mechanical property and the at least one hydraulic fracture parameter. The process includes predicting a fracture closure pressure (FCP) for a potential wellbore based on the trained machine learning model.

In some implementations, the process includes predicting a fracture closure pressure (FCP) for a potential wellbore based on a 3D mechanical earth model, wherein the 3D mechanical earth model is built based on the trained machine learning model and at least one of well logs and mechanical test data for wells in the subsurface region.

In some implementations, the 3D petrophysical property comprises porosity, permeability, and petrophysical rock types.

In some implementations, the 3D geo-mechanical property comprises rock elastic properties, rock strength properties, stress regime profiles, wellbore stability, and brittleness. In some implementations, the at least one hydraulic fracture parameter comprises fracture closure pressure and an injection rate.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes systems and processes for identifying fracable areas in a subsurface region. A machine learning model is generated to predict discrete fracability index values based on a determined fracture closure pressure (FCP) at locations in the subsurface region. A data processing system executes the machine learning model to determine the fracable areas. The data processing system is configured to train the machine learning model using data from a combination of 3D models for the subsurface region. The models include values of petrophysical properties in the subsurface region. The models include values of geo-mechanical properties in the subsurface region. The models include a fracture model obtained from one or more wells in the subsurface region. The fracture model includes a fitness function that is tuned by adjusting hydraulic fracture parameters for the subsurface region. The hydraulic facture parameters include a fracture closure pressure (FCP), injection rate, and breakdown pressure.

The machine learning model (e.g., a supervised machine learning model) receives the outputs of the 3D models as inputs. The machine learning model predicts FCP from existing hydraulic fractured wells. The data processing system performs a calibration between the well logs and mechanical test data. The data processing system, based on the calibration, determines an area with a favorable fracability index value, prior to drilling. The machine learning model enables improved well placement and field development for a subsurface region Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Figure 1:
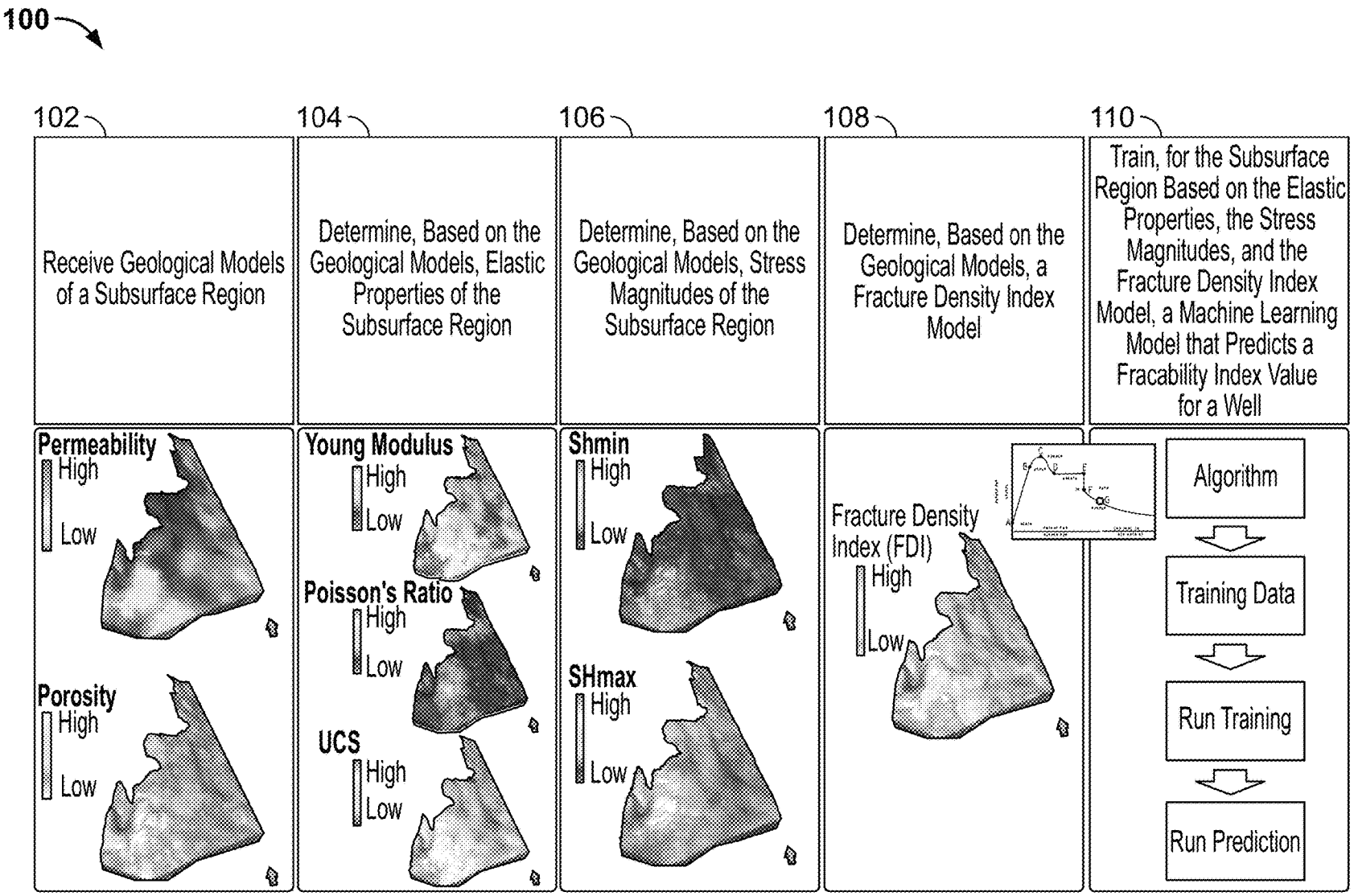
FIG. 1 is a schematic diagram showing a process for developing a machine learning model configured for identifying fracable areas.

FIG. 1 is a schematic diagram showing a process 100 for developing a machine learning model configured for identifying fracable areas. A machine learning model is trained using data from 3D models of a subsurface region. The 3D models are subsequently described in further detail.

A data processing system is configured to receive (102) a 3D geological model of a subsurface region. The 3D geological model can include permeability data and porosity data. These models are described in relation to FIGS. 2-3. The data processing system is configured to determine (104), based on the geological models, elastic properties of the subsurface region. The elastic properties include values for Young's modulus, Poisson's ratio, and UCS. These models are subsequently described in relation to FIGS. 5, 6, and 7A-7B. The data processing system is configured to determine (106), based on the geological models, stress magnitudes of the subsurface region. The determination of the stress magnitudes is described in relation to FIGS. 9-10. The data processing system is configured to determine (108), based on the geological models, a fracture density index model for the subsurface region. The fracture density index models are subsequently described in relation to FIGS. 11A-11B. The data processing system is configured to train (110), for the subsurface region based on the elastic properties, the stress magnitudes, and the fracture density index model, a machine learning model that predicts a fracability index value for a well. The training of the machine learning model for the data processing system is described in relation to FIGS. 17A-17B.

The data processing system identifies fracable zones in the subsurface region for hydraulic fracturing stimulation for naturally fractured reservoirs. The fracable zones are relatively more likely to be productive, relative to other zones in the subsurface region that are less likely to be productive. Here, productivity refers to a production of hydrocarbons from a well. The data processing system trains the machine learning model to identify fracable zones based on three geological components. These components are represented by petrophysical properties, geomechanical properties, and natural fractures, which are distributed in 3D models in the subsurface region by processing data of the 3D grid geological reservoir model.

The 3D petrophysical model is based on the geological description involving the petrophysical characterization and modeling of rock properties. Petrophysical properties include porosity, permeability and petrophysical rock types (PRT).

The 3D geomechanical model includes estimated values of mechanical earth model properties for the subsurface region. The mechanical earth model properties include rock elastic properties, rock strength properties, stress regime profiles and wellbore stability.

Mechanical earth modeling require an ability to model the rock mechanical properties, stress regime and wellbore stability by parametrizing the formation geomechanical parameters or properties involved in the model. As will be described, the present invention obtains measures of the variability of the formation stress regime as affected by a selected number of different sets of the formation geomechanical parameters. Processing according to the present invention develops expressions for physical relationships of various rock mechanical properties, modeling what are known as "in situ" stress conditions, and quantifying as an error function representing as errors the differences between the minimum horizontal stress predicted and actual well measurements (fracture closure pressure) from well testing.

The natural fractures model includes data representing discretized fluid-flow paths for the subsurface region. The fracture model includes values resulting from a critical stress analysis, allowing the data processing system to determine a normal effective value for the subsurface region. The data processing system also determines, from the fracture model, shear stress values for each plane in the fracture network.

Shear failure is caused by two perpendicular stresses acting on the same plane, and is defined in conjunction with a Mohr diagram by the following equation expressing stress conditions: $\sigma 1' \geq C0 + \sigma 3 \tan 2\beta$ where C0=Unconfined compressive strength, $\sigma 1'$=Maximum effective stress, $\sigma 3'$=Minimum effective stress, $\beta$=Angle between the normal stress and the maximum effective stress $\sigma 1'$, and where $\varphi$ is the friction angle $\beta = 45° + \varphi/2$. This is described in further detail in WIPO Appl. Pub. No. WO2021/167980, titled "Determination of calibrated minimum horizontal stress magnitude using fracture closure pressure and multiple mechanical earth model realizations," and published on Aug. 26, 2021, the contents of which are incorporated by reference herein in entirety.

The data processing system combines the 3D petrophysical model, the 3D geomechanical model, and the fracture model. The data processing system also receives as an input values for actual hydraulic fracturing parameters derived from diagnostic formation injection tests (DFIT). The DFIT includes a test in existing wells to establish parameter values for each of these three models using data from the existing wells. The data processing system executes a machine learning model on the data generated by these three models to classify areas of the subsurface as fracable or not fracable. In some implementations, the machine learning model provides a relative fracability for a location in the subsurface region. The fracability is represented by a value (e.g., an index value between 0-1).

Figure 2:
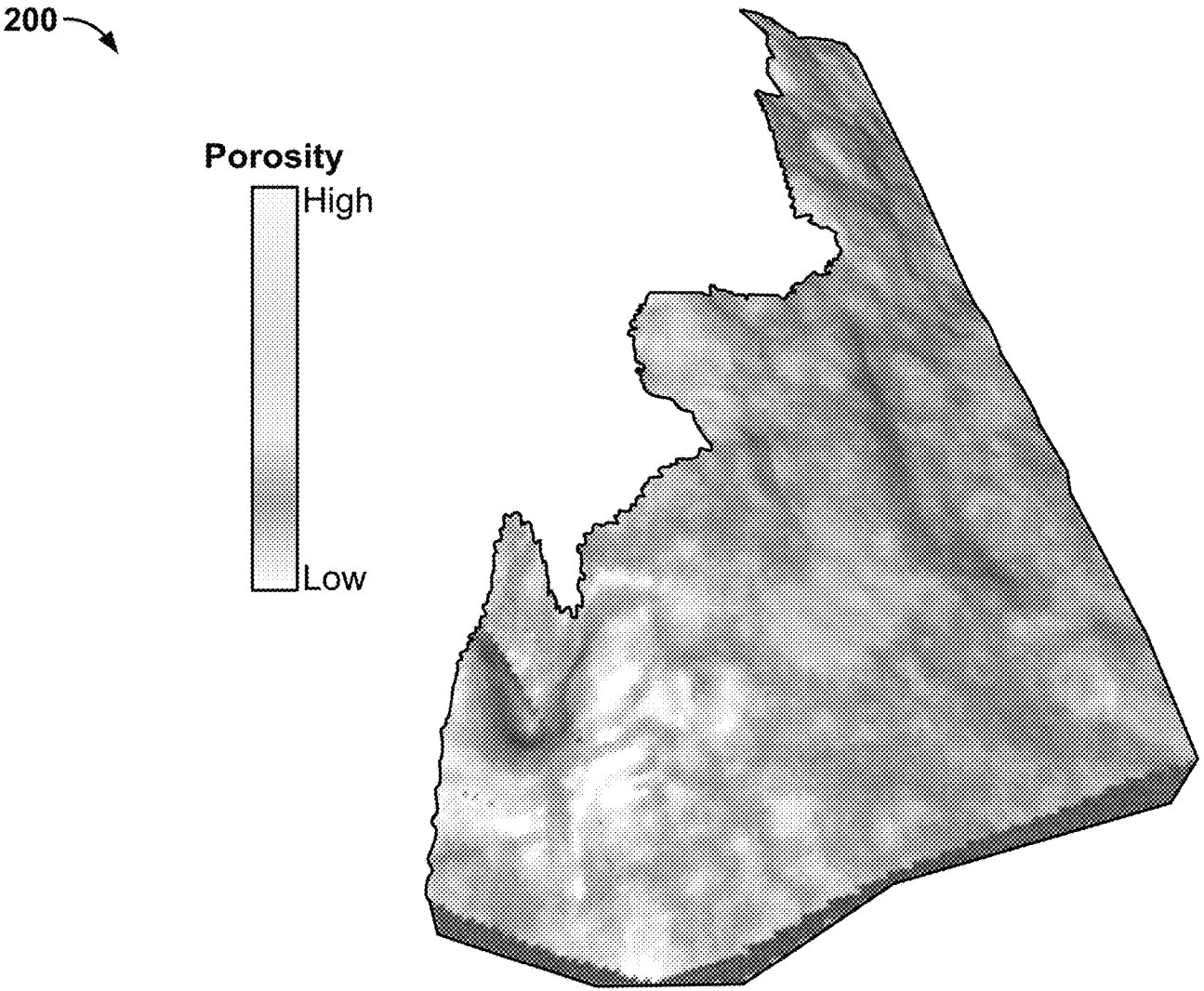
FIG. 2 shows an illustration of a 3D model of a subsurface region showing a porosity distribution in the subsurface region.
Figure 3:
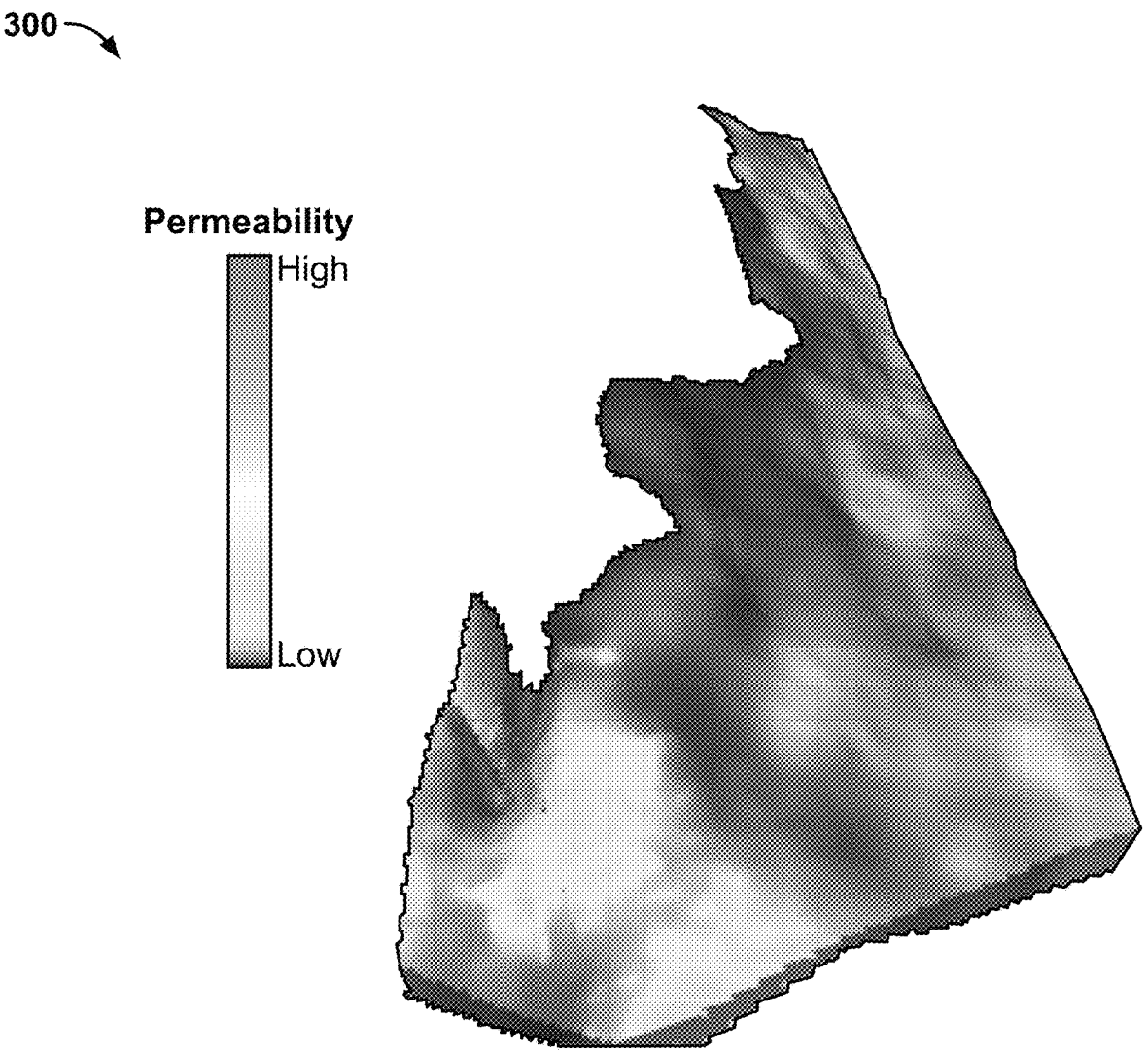
FIG. 3 shows an illustration of a 3D model of a subsurface region showing a permeability distribution in the subsurface region.

FIG. 2 shows an illustration of a 3D model 200 of a subsurface region showing a porosity distribution in the subsurface region. The 3D model 200 is a portion of the 3D petrophysical model 102 that generates data to be input into the machine learning model described in FIG. 1. FIG. 3 shows an illustration of a 3D model 300 of a subsurface region showing a permeability distribution in the subsurface region. The 3D model 300 is a portion of the 3D petrophysical model 102 that generates data to be input into the machine learning model described in FIG. 1. Models 200 and 300 provide inputs to the machine learning model regarding the petrophysical properties such as porosity, clay volume, permeability and water saturation. The petrophysical parameter values are produced by a petrophysical interpretation of the subsurface. The data processing system determines possible intervals in a proposed well with a high fluid saturation or high porosity and permeability. Additionally, the data processing system can extrapolate the petrophysical properties within a 3D grid model utilizing several geostatistic methods such as kriging, Sequential Gaussian Simulation (SGS), and so forth.

Turning to FIG. 2, the data processing system determines a porosity distribution for the subsurface region. The data processing system determines the porosity distribution by processing wireline log data values, such as bulk density values, gamma ray values, and neutron porosity values. The data processing system processes core-plug measurements integrated inside a petrophysical workflows to determine porosity log at well level. The porosity log can be used as input for geological modeling workflow, where the spatial distribution and ranges could be evaluated in the 3D domain.

The data processing system can extrapolate the porosity into a 3D grid model 200 using co-kriging algorithm following an additional or secondary property such as acoustic impedance extracted from seismic volume cube, facies or other type of guide. The model 200 includes an example porosity distribution within a 3D grid model of a given subsurface region.

Turning to FIG. 3, the data processing system generates the permeability distribution of the model 300. The data processing system determines the permeability distribution for the subsurface region by processing values from the porosity model 200 and one or more permeability core-plug measurements. The data processing system identifies correlations among the data based on rock-typing and pore-throat analysis to determine different hydraulic flow units that could dominate the fluid-flow for the reservoir. When the data processing system determines the permeability at a well level, a permeability log is extrapolated inside the 3D grid model 300. The data processing system performs this extrapolation by following the porosity values as a co-kriging parameter to guide permeability predictions.

Figure 4:
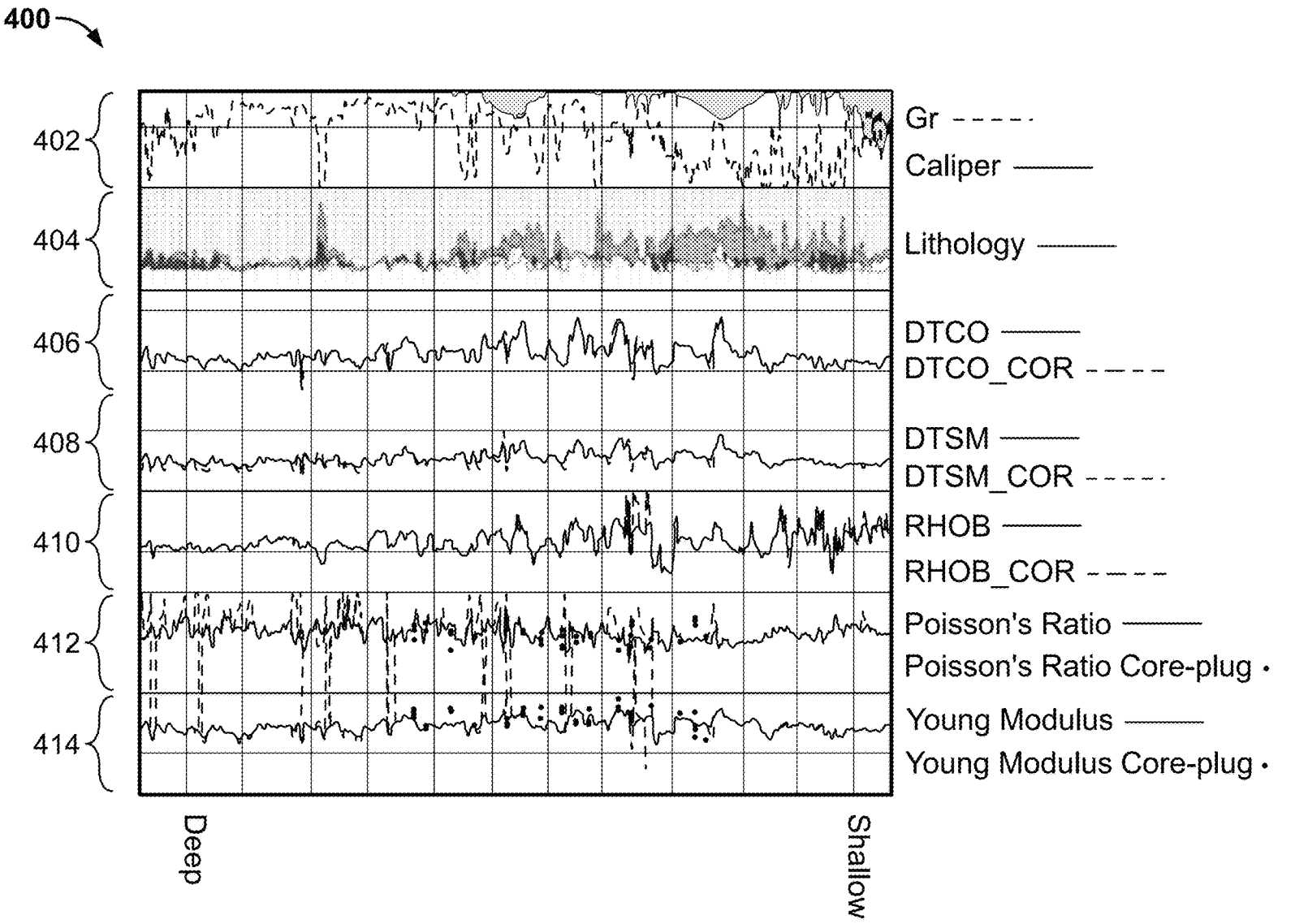
FIG. 4 shows an illustration of a rock physics model that is integrated with a rock mechanical test.

FIG. 4 shows an illustration of a rock physics model 400 that is integrated with a rock mechanical test. The data processing system is configured to determine rock elastic properties from sonic acoustic wave data and from rock mechanical test data. The data processing system performs rock physics analysis before calculation of the elastic properties. The data processing system, by performing the rock physics analysis, removes environmental effects and gas effects from the sonic acoustic log response. This procedure includes (1) original logs splice, depth shift, environmental corrections, (2) multi mineral analysis to identify mineralogical components, porosity and fluid saturations and (3) rock physics modeling of acoustic and density logs accounting for these components and their physical properties (mineral and fluid densities and elastic moduli, pores distribution, shapes and orientations, grain to grain contacts). The data processing system generates mechanical properties data. For example, the mechanical properties data include caliper data and a Gr function values 402. The mechanical properties data include lithology data 404. The lithology data 404 describe the geochemical, mineralogical, and physical properties of rocks in the subsurface region. The mechanical properties data include compressional wave transit times (DTCO) data 406. The mechanical properties data include shear wave transit times (DTSM) data 408. The mechanical properties data include density (RHOB) data 410. The mechanical properties data include Poisson's ratio data 412. The mechanical properties data include Young's Modulus values 414.

The data processing system corrects the acoustic log using the mechanical properties data 400. The data processing system performs an extrapolation inside the 3D grid model of the subsurface using a geostatistics process, which can be collocated with additional variables in order to guide the extrapolation and produce consistent results.

Figure 5:
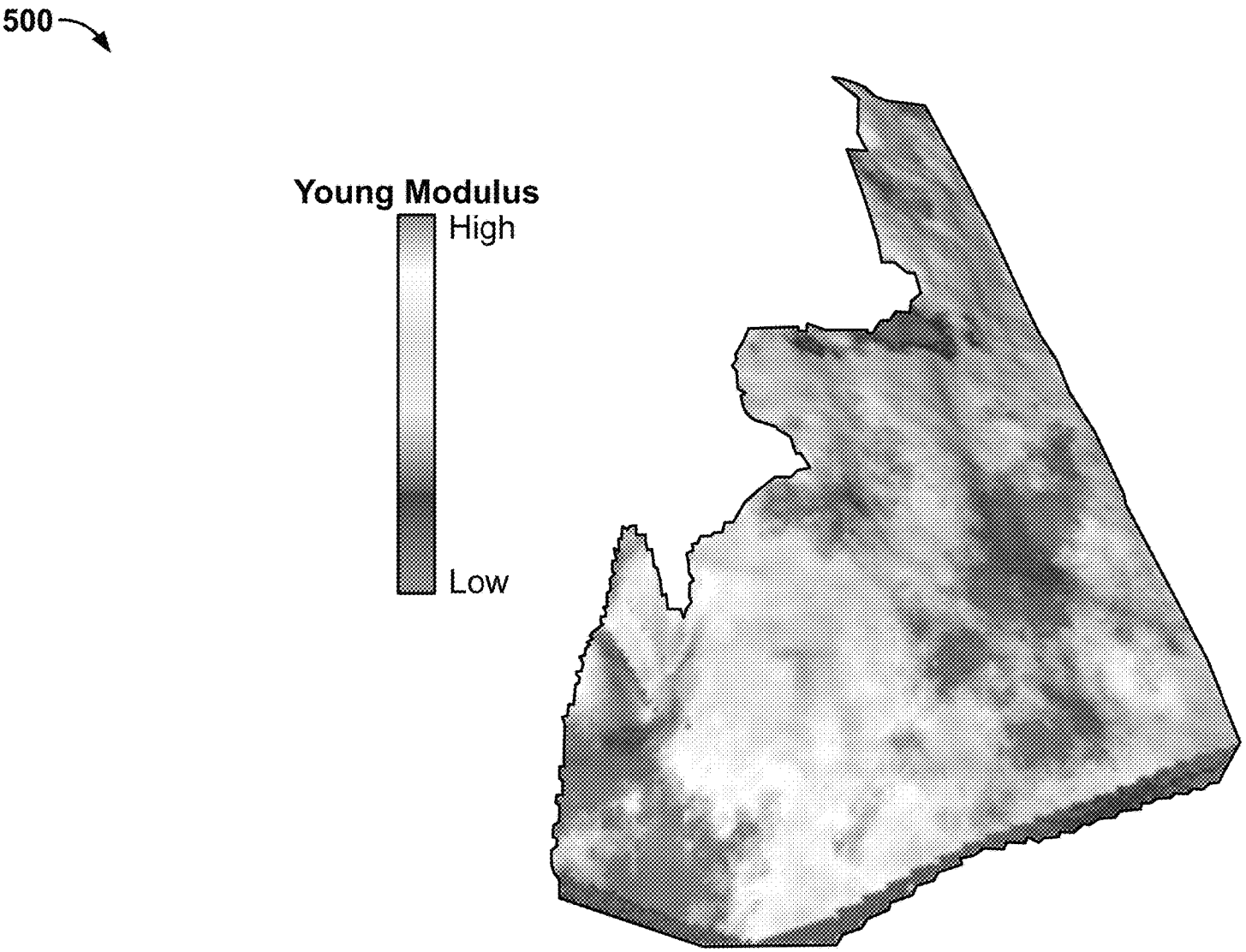
FIG. 5 shows an illustration of a 3D model of a subsurface region showing a Young's modulus distribution in the subsurface region.
Figure 6:
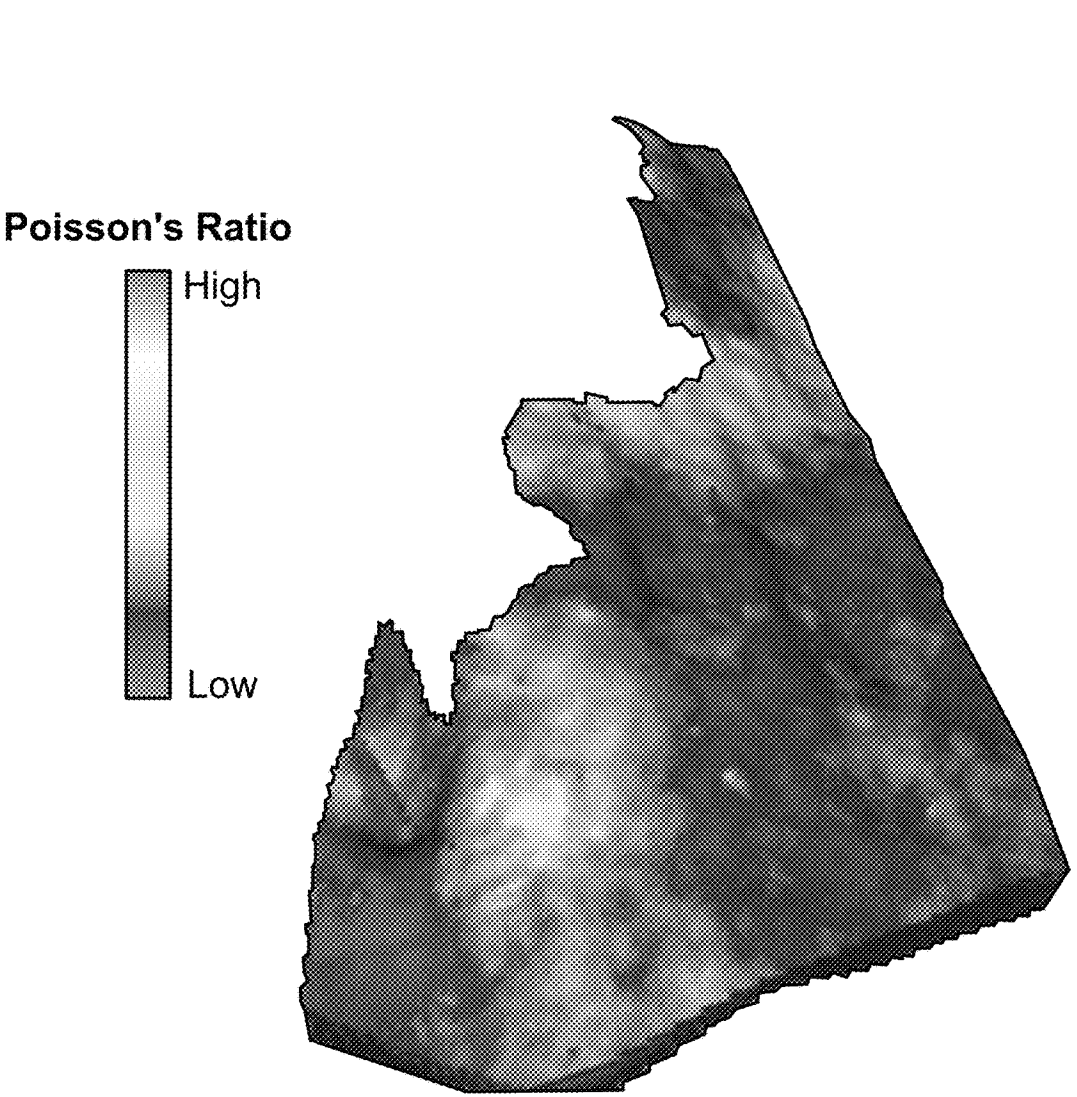
FIG. 6 shows an illustration of a 3D model of a subsurface region showing a Poisson's ratio distribution in the subsurface region.

FIG. 5 shows an illustration of a 3D model 500 of a subsurface region showing a Young's modulus distribution in the subsurface region. FIG. 6 shows an illustration of a 3D model 600 of a subsurface region showing a Poisson's ratio distribution in the subsurface region. The 3D model 500 is a portion of the 3D geomechanical model 104 that generates data to be input into the machine learning model described in FIG. 1. The 3D model 300 is a portion of the 3D geomechanical model 104 that generates data to be input into the machine learning model described in FIG. 1. The data processing system generates the models 500 and 600 to provide inputs to the machine learning model.

The data processing system determines each of a Young's Modulus distribution in the subsurface region and a Poisson's Ratio distribution in the subsurface region. The data processing system can generate each of the 3D models 500 600 from acoustic wave and bulk density response data for the subsurface region. The data processing system generates results that include a logs profile. The logs profile data include "dynamic" response data. The data processing system is configured to transform the logs profile data to "static" or calibrated mechanical logs. The data processing system applies a conversion equation for correlating the dynamic to static mechanical responses.

A stress tensor prediction performed based on transforming relationships expressed in terms of dynamic rock mechanical properties to relationships expressed in terms of static rock mechanical properties. This is done based on suitably determined rock strength properties correlations. The rock strength properties are defined based on correlation functions. Examples of such correlation functions according to the present invention are between the dynamic Young's Modulus vs. static Young's Modulus. This is described in further detail in WIPO Appl. Pub. No. WO2021/167980, titled "Determination of calibrated minimum horizontal stress magnitude using fracture closure pressure and multiple mechanical earth model realizations," and published on Aug. 26, 2021, the contents of which are incorporated by reference herein in entirety.

The data processing system performs the extrapolation of the Young's Modulus and Poisson's Ratio distributions inside the 3D grid models 500, 600. The data processing system performs extrapolation based on guide elastic properties from 3D seismic attributes or geostatistic methods, previously described.

Figure 7A:
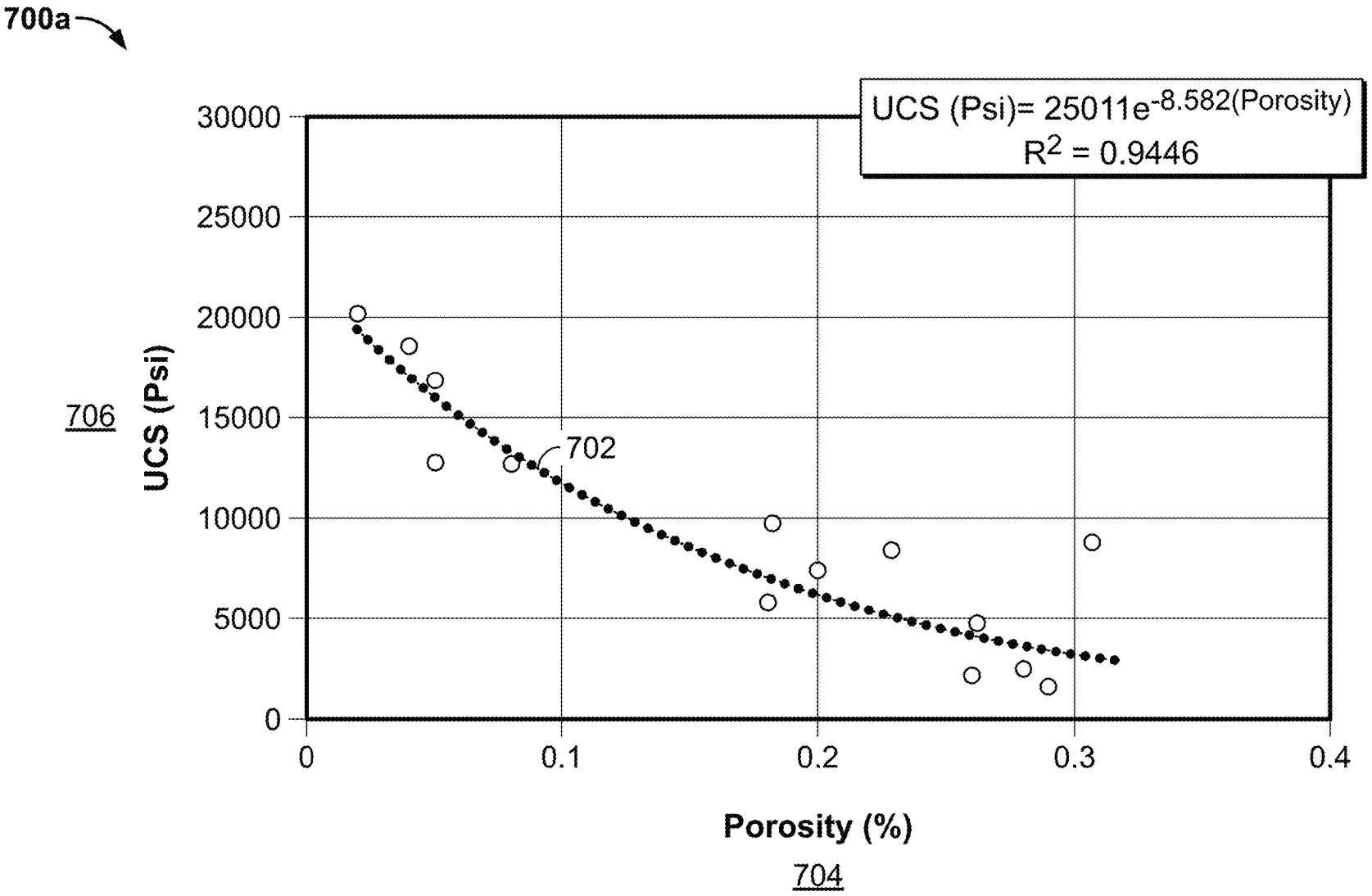
FIG. 7A is a graph showing a relationship between a porosity and a uniaxial compressive strength (UCS) of a subsurface region.
Figure 7B:
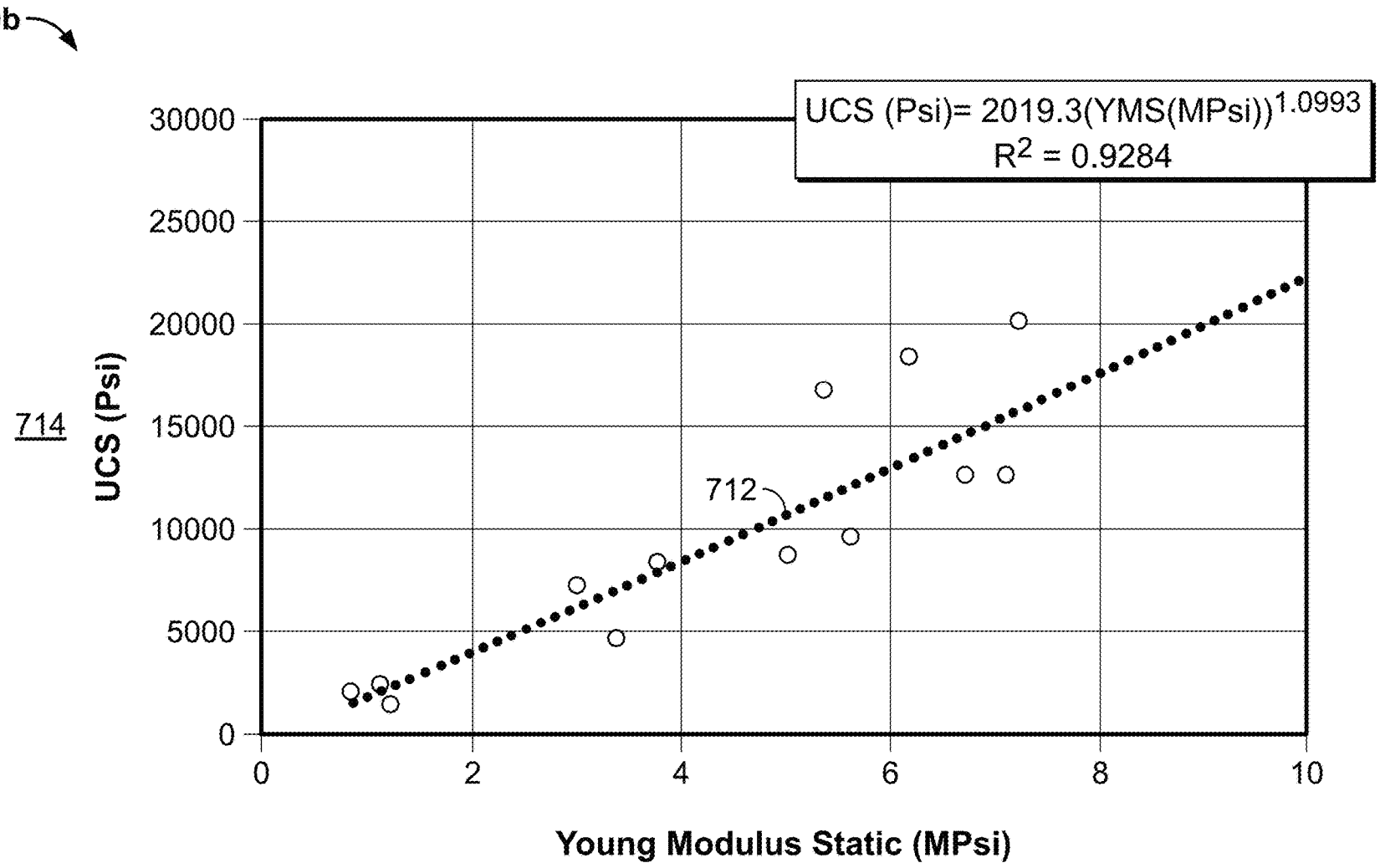
FIG. 7B is a graph showing a relationship between values for Young's Modulus (static) and a uniaxial compressive strength (UCS) of a subsurface region.

FIG. 7A is a graph 700*a* showing a relationship between a porosity and a uniaxial compressive strength (UCS) of a subsurface region. The UCS values 706 are measured in pounds per square inch (PSI). The porosity 704 is measured as a percentage value. The relationship 702 between the UCS and porosity values is non-linear. FIG. 7B is a graph 700*b* showing a relationship between values for Young's Modulus (static) 710 and a uniaxial compressive strength (UCS) 714 of a subsurface region. The UCS is measured in pounds per square inch (PSI). Young's Modulus is shown in mega-PSI (MPSI).

Figure 8:
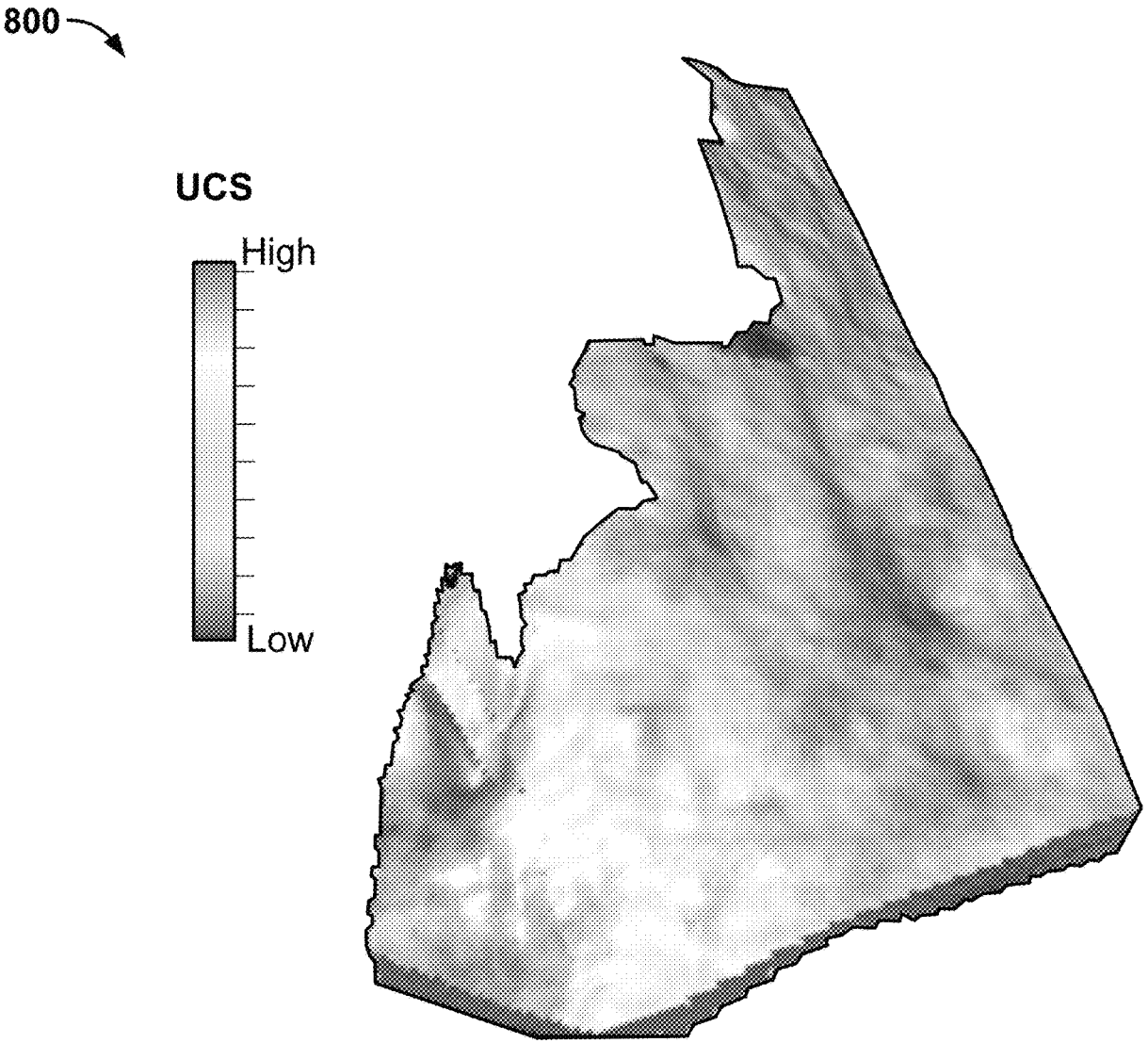
FIG. 8 shows an illustration of a 3D model of a subsurface region showing values of UCS in the subsurface region.

The data processing system modes the UCS inside a 3D grid model 800 of FIG. 8 using the rock mechanical correlation between the static properties such as Young's Modulus or porosity, described previously. The data processing system obtains the empirical correlations from unconfined compressive testing in the subsurface region. The data processing system obtains the empirical correlations using multi-stage tri-axial testing in the subsurface region. Graphs 700*a*-700*b* show the empirical correlation measured from mechanical core-plug testing.

FIG. 8 shows an illustration of a 3D model 800 of a subsurface region showing values of UCS in the subsurface region. The values of the UCS are determined as described in relation to FIGS. 7A-7B. Specifically, the distribution of the UCS property across the 3D grid model 800 is determined by the data processing system using the established correlation with the Young's Modulus static. The UCS distribution is included in the model 104 for being input into the machine learning model, as described in relation to FIG. 1.

Figure 9:
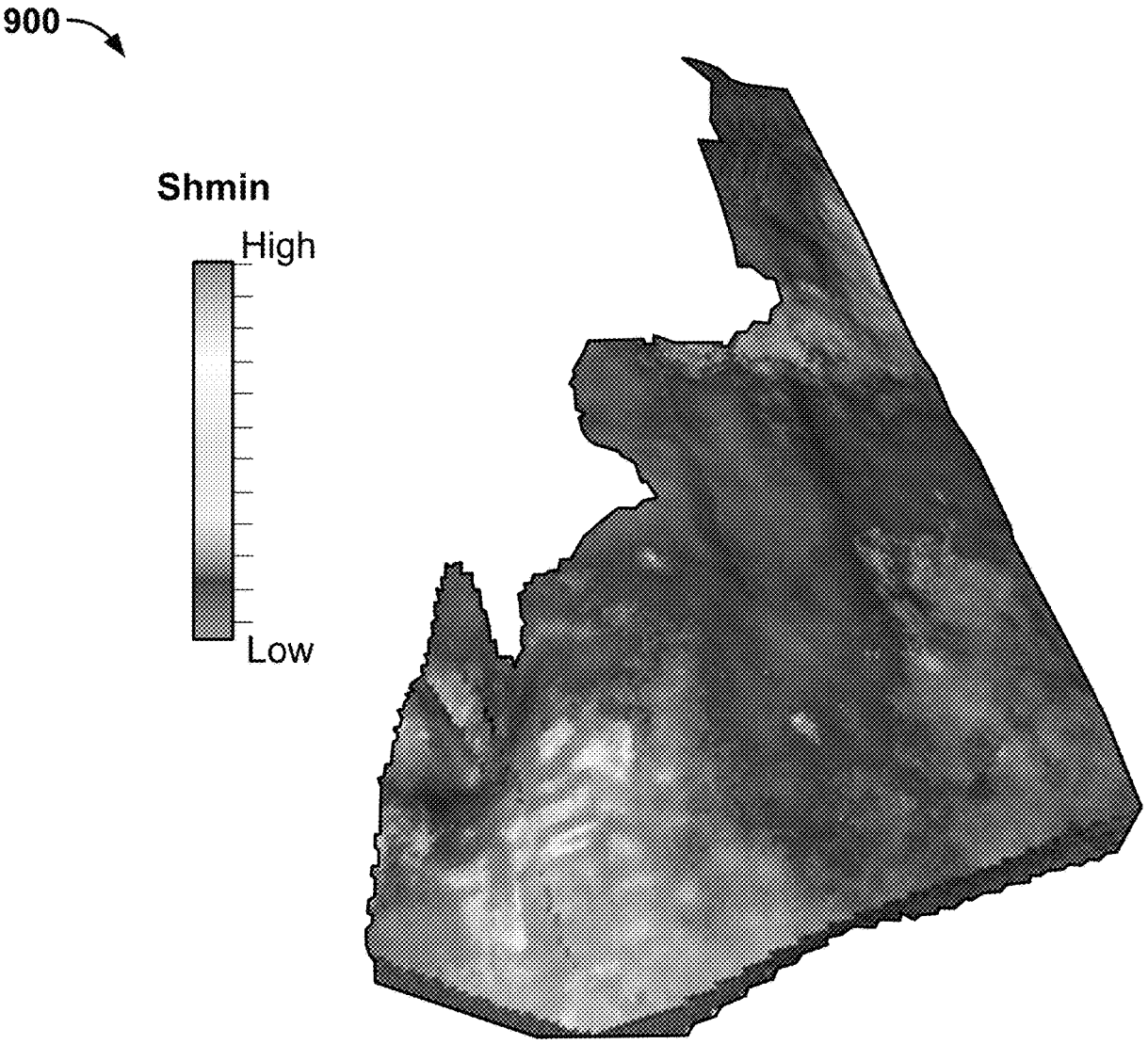
FIG. 9 shows an illustration of a 3D model of a subsurface region showing values for a minimum horizontal stress magnitude in the subsurface region.
Figure 10:
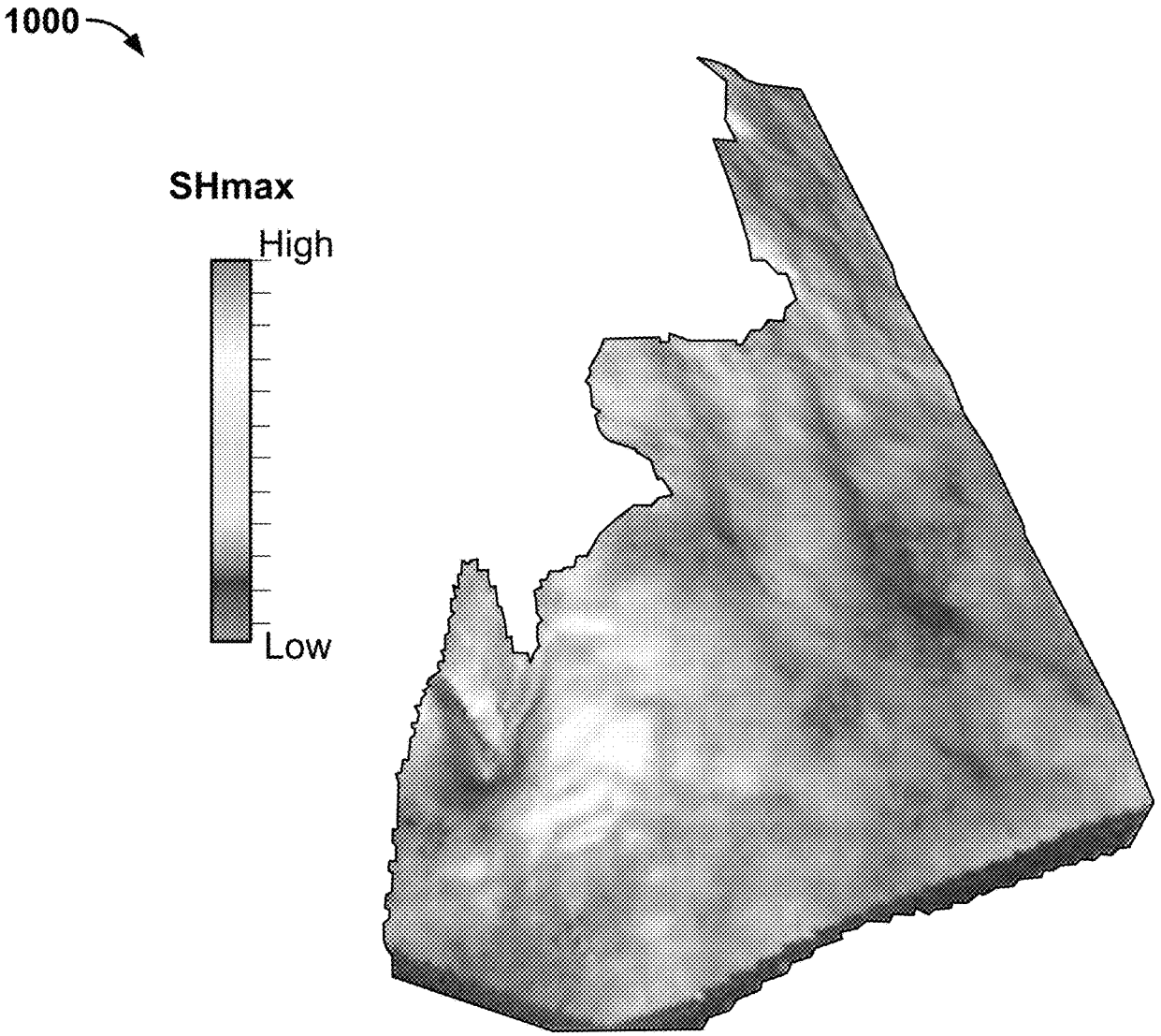
FIG. 10 shows an illustration of a 3D model of a subsurface region showing values for a maximum horizontal stress magnitude in the subsurface region.

FIG. 9 shows an illustration of a 3D model 900 of a subsurface region showing values for a minimum horizontal stress magnitude in the subsurface region. FIG. 10 shows an illustration of a 3D model 1000 of a subsurface region showing values for a maximum horizontal stress magnitude in the subsurface region. The 3D models 900, 1000 are each a portion of the geomechanical data 106 to be input into the machine learning model described in FIG. 1.

The in-situ stress magnitude is part of the 3D mechanical Earth modeling process. The data processing system performs a finite element simulation to compute stress and strain tensors. The data processing system models the geomechanical facies representing the mechanical rock types for the subsurface region.

The data processing system, to perform the 3D stress analysis, calculates stresses that represent the pre-production conditions throughout the subsurface and the surrounding reservoir. Due to the complex variation of structure and properties within the model, the data processing system solves the stress equilibrium numerically. In some implementations, the data processing system performs a geomechanical simulation by a finite element method to determine the solution. The data processing system produces a 3D stress tensor in which magnitude and orientation vary laterally and vertically. The data processing system generates the models 900, 1000 using the 3D structure of the subsurface, the rock mechanical properties, and loads that govern stresses (e.g., gravitational, pore pressures and boundary conditions) to simulate the initial stress state of the subsurface. These data are provided by the models 200, 300, 500, and 600, and data 400.

In some implementations, the data processing system calibrates the minimum horizontal stress for model 900 by processing data including a fracture closure pressure gradient, leak-off test data, and other formation integrity tests.

In some implementations, the data processing system determines a maximum horizontal stress magnitude for the model 1000 by processing data from a wellbore stability model. The maximum horizontal stress σHmax is determined based on the poro-elasticity equation and wellbore stability modeling, and calibrated with wellbore failure analysis such as "breakouts" and "drilling induce tensile fractures" from borehole image interpretation. This is described in further detail in WIPO Appl. Pub. No. WO2021/167980, titled "Determination of calibrated minimum horizontal stress magnitude using fracture closure pressure and multiple mechanical earth model realizations," and published on Aug. 26, 2021, the contents of which are incorporated by reference herein in entirety.

Figure 11A:
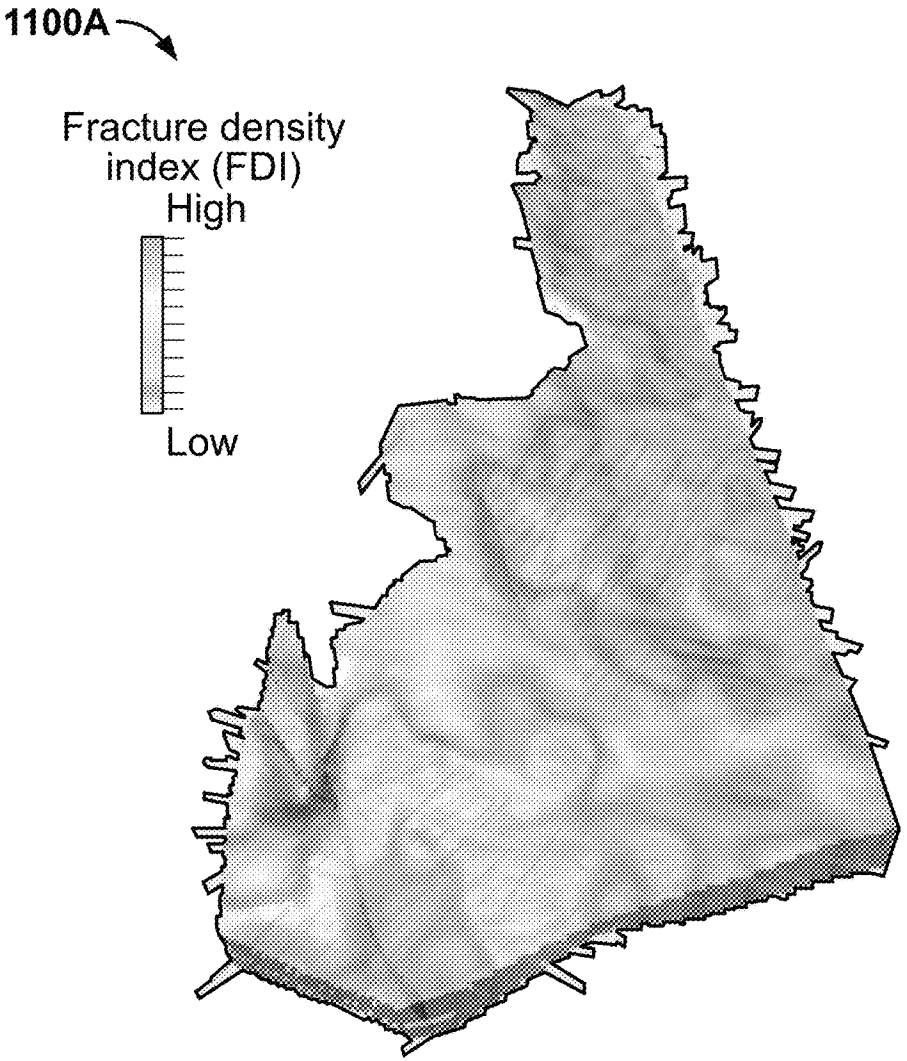
FIG. 11A shows an illustration of a 3D model of a subsurface region showing values for a fracture density index in the subsurface region.
Figure 11B:
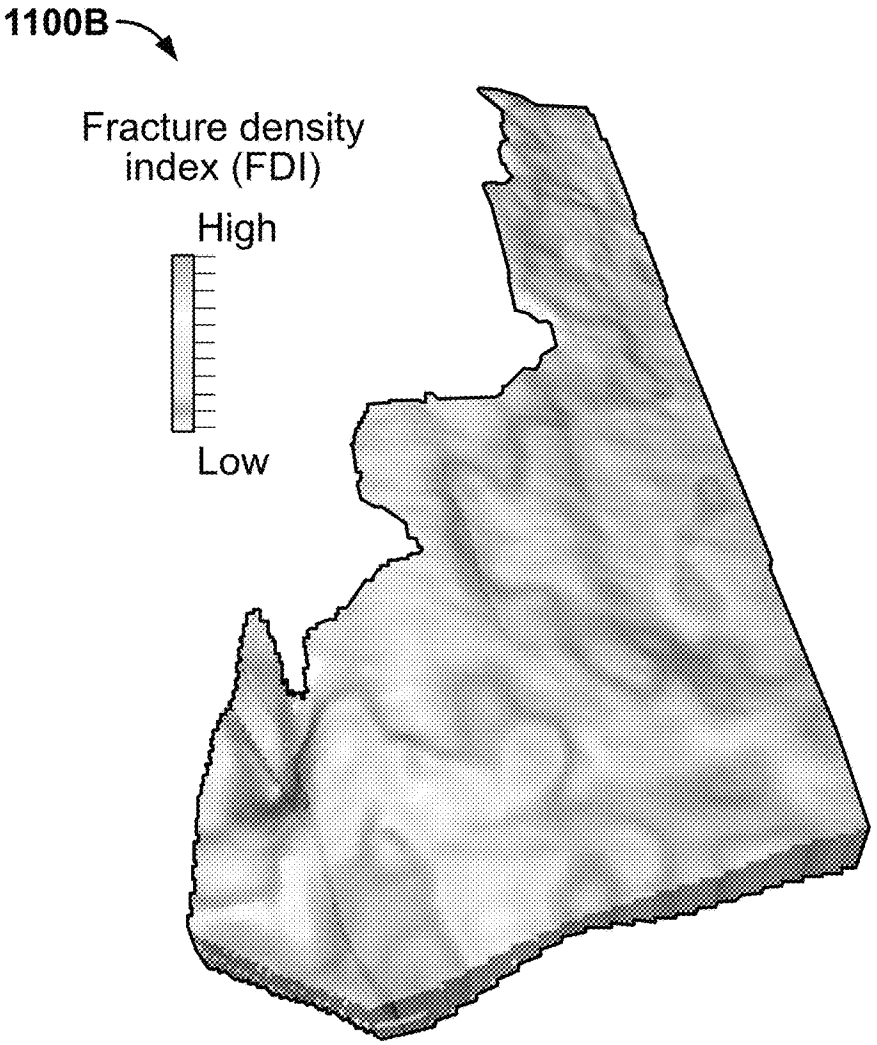
FIG. 11B shows an illustration of a 3D model of a subsurface region showing values for a fracture density index in the subsurface region.

FIG. 11A shows an illustration of a 3D model 1100*a* of a subsurface region showing values for a fracture density index in the subsurface region. FIG. 11B shows an illustration of a 3D model 1100*b* of a subsurface region showing values for a fracture density index in the subsurface region. The data processing system generates a Fracture Density Index (FDI) model 1100*a-b* by performing a re-sampling method to represent a normalized density of fluid-flow path occurrences in the subsurface region. The data processing system processes directly the discrete fracture planes. The data processing system transforms the 3D discrete fracture networks geometry and distribution into fracture density raster data. Raster data includes gridded data where each grid unit is associated with a specific geographical location. The transformation permits the generation of informative maps of the subsurface by the data processing system. The maps can be configured to highlight relatively likely spots for natural fractures. The data processing system determines the fracture density index model 1100*a-b* based on geostatistics modeling tools. The data processing system performs construction of the fluid-flow path model from discrete natural fracture model. Model 1100*a* shows the FDI with the discrete fracture planes. Model 1100*b* shows the FDI variations across the subsurface region.

For performing construction of the fluid-flow path model from discrete natural fracture model, the following process is performed. A geomechanics fracture indicator process of natural fracture model prediction processing stage forms indications of fractures based on selected rock mechanical properties distributed for the 3D geomechanics model. The mechanical stratigraphy is defined using the Brittleness concept can be used as a geomechanics fracture indicator to define the fracture position and density or spacing through the layering. A strain or plastic strain model can be used as indicator of fracture orientation (Dip and azimuth) and possible areal/volumetric density distribution, according with the kind of geological structural environment. Several components of fractures can be considered as geomechanics indicator for fractures, as for example: fractures relate to folding and fractures related to faulting. The quantifications about the strain are only qualitative in terms of real fracture density present in the reservoir.

In a fracture indicator controller process of natural fracture model prediction processing, attributes determined from seismic fracture detection process and geomechanics fracture indicator process are compared in terms of fracture position, fracture density and orientation in a qualitative way, to evaluate possible coincidence zones, between the models, where natural fractures can be expected to be created. In some cases, these processes are complementary due to the different vertical and areal resolution in which both of them are calculated.

The discrete fracture network model is performed subsequent to identification of natural fracture location in the fracture indicator controller process. The discrete fracture network method is a useful technique to build a representative natural fracture model based on stochastic mathematical simulations. This technique required a fracture controller and the intensity, orientation from a 1D natural fracture characterization.

The fracture modeling receives the results of the 1D natural fracture characterization, which is obtained from the borehole image resistivity analysis or acoustic image interpretation of the rock general characterizations and represents the intensity fracture, aperture, fracture classification and fracture orientation along a wellbore.

The fracture intensity model is calculated using the fracture indicator controller as a result of the intensity fracture characterization. It will constrain the orientation and fracture intensity in a qualitative way the fracture intensity model. The real fracture intensity quantification can be completed, and this output can be used to predict the natural fracture model through the discrete fracture network methodology. For fracture intensity quantification proposes the fracture intensity has to be normalized to be able to compare with the BHI fracture intensity. This process is described in detail in U.S. Pat. No. 10,607,043, titled "Subsurface reservoir model with 3D natural fractures prediction," issued on Mar. 31, 2020, the contents of which are incorporated by reference in entirety.

Figure 12:
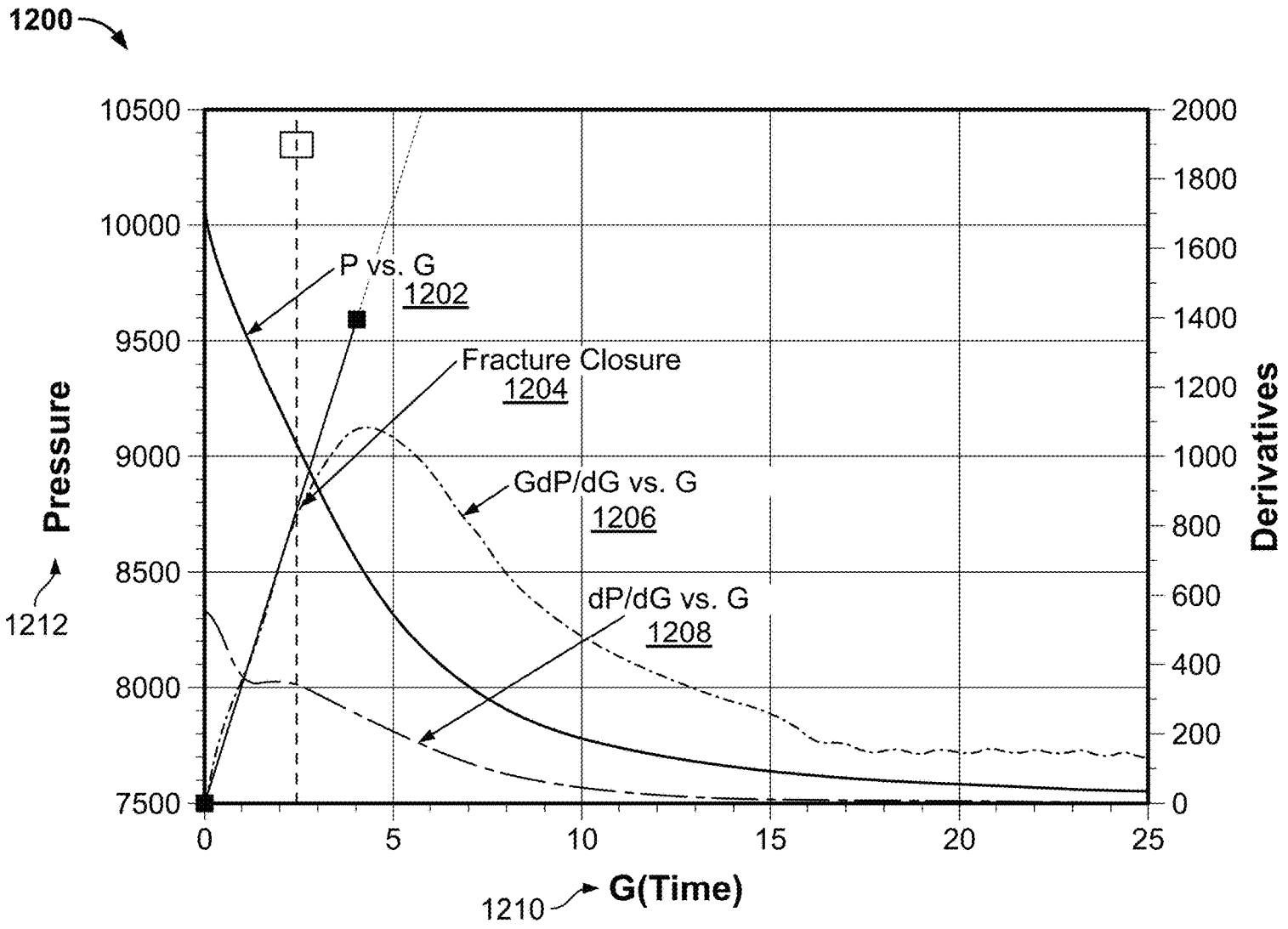
FIG. 12 is a graph showing pressure vs. time for G-functions.

FIG. 12 is a graph 1200 commonly referred to as the G-function plot, showing pressure and its derivatives vs. G-function. The G-function is a representation of the elapsed time after shut-in normalized to the duration of fracture extension time and is dimensionless. The figure includes three curves; i) a plot of P vs. G 1202 where P (psi) is the measured pressure after shut-in (i.e. cessation of pumping into the formation), ii) GdP/dG (in psi) vs. G 1206 is a semi-log derivative of pressure plot vs. G, and iii) a first derivative dP/dG vs. G. 1208. The essence of this plot is the picking of Fracture Closure from an injection test (DFIT). The point marked Fracture Closure 1204 is the point of departure of curve 1206 from the straight line passing through the origin.

Figure 13:
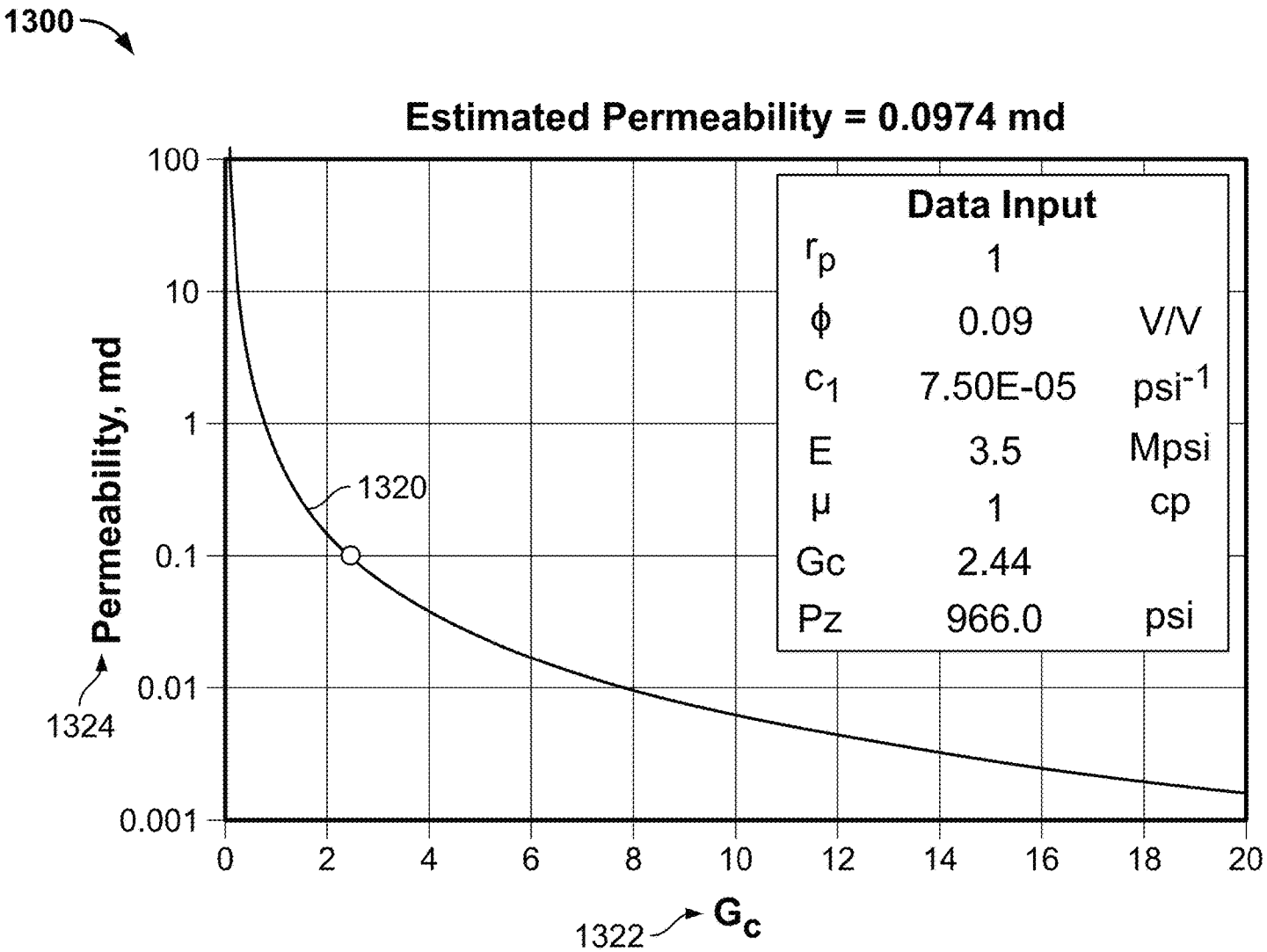
FIG. 13 is a graph showing permeability vs. G-function values.

FIG. 13 is an example graph (1300) showing the correlation of formation permeability vs. G-function values. The relationship 1320 relates permeability (md) 1324 to G-function closure time (GC, dimensionless time) values 1322 based on an empirical function. The empirical correlation was derived from numerous numerical simulations of fracture closure considering the leak-off and mobility of the injected fluid in a defined fracture geometry. This is described in Barree, R. D. et. al, "Holistic Fracture Diagnosis," presented at the Rocky Mountain Oil & Gas Technology Symposium, Denver, Colorado, U.S.A., April 2007, paper number: SPE-107877-MS, the contents of which are incorporated by reference herein in entirety. The formation permeability derived from this type of correlation has been referred to as G-perm in this disclosure.

The data processing system executes a supervised model predictive of fracture closure pressure (FCP) from hydraulic fracturing. The FCP is generally predictable within the stimulation intervals. The data processing system uses an integrated mechanical earth model and petrophysical properties in order to predict fracability prior to drilling. The machine learning model includes a regression model. The machine learning model predicts continuous values of FCP. The data processing system drops features that are not relevant for predicting future FCP values. The dropped features generally include well name and well depth (among other such features).

The fracture closure pressure (FCP) is obtained from pre-main fracture calibration tests known as the diagnostic fracture injection tests (DFIT). The DFIT are routinely executed to gather critical information of the reservoir. In some implementations, the DFIT include small volume, plain water, pump-in treatments that provide data for designing fracturing treatment and characterizing the reservoir. The DFITs are analyzed in two phases. A first phase occurs before closure (BC). A second phase occurs after closure (AC). The DFIT tests are used to acquire reservoir pore pressure, detailed closure and fracture gradients, process zone stresses (PZS, or net pressure), transmissibility values which can be converted into reservoir permeability values, and leak-off mechanisms. The output values of the DFITs for unconventional reservoirs provide an equivalent of a traditional pressure transient test used in conventional reservoirs. The DFIT provides meaningful reservoir information in short test times. Generally, test times may otherwise occur over months or even years to reach pseudo-radial flow regime in tight reservoirs, as shown in graph 1200. In cases where pseudo-radial flow regime is not reached and some estimate of reservoir permeability is desired, an empirical correlation developed from the G-function closure time through numerous numerical simulations of fracture closure can be used, as shown in graph 1300.

The data processing system uses the fracture calibration tests to help create a more realistic description of a complex reservoir environment. The magnitude values and transient behavior of the values for net pressure(s), and friction pressure(s) are attributed to non-ideal behaviors including poro-elastic effects (tight rock), multiple fracturing events, near wellbore tortuosity, wellbore trajectory, fracture re-orientation while fracturing, presence of natural fractures, changes in rock lithology, in-situ stresses, damaged zone, and so forth. The data processing system, by using an integrated approach, increases a likelihood of resolving reservoir complexities. The data processing system thus pinpoints desirable fracturing locations.

The data processing system solution is predictive of FCP. In tests, the data processing system machine learning model mean absolute error was about 130 Psi on average. Moreover, coefficient of determination was about 99%. This shows that there was not much variation in prediction results. Example machine learning models can include a trees regressor, which is a variation of random forest in which a cut is randomly defined. The machine learning can include a tree algorithm such as decision tree regressors, random forest, and extreme gradient models.

Figure 14:
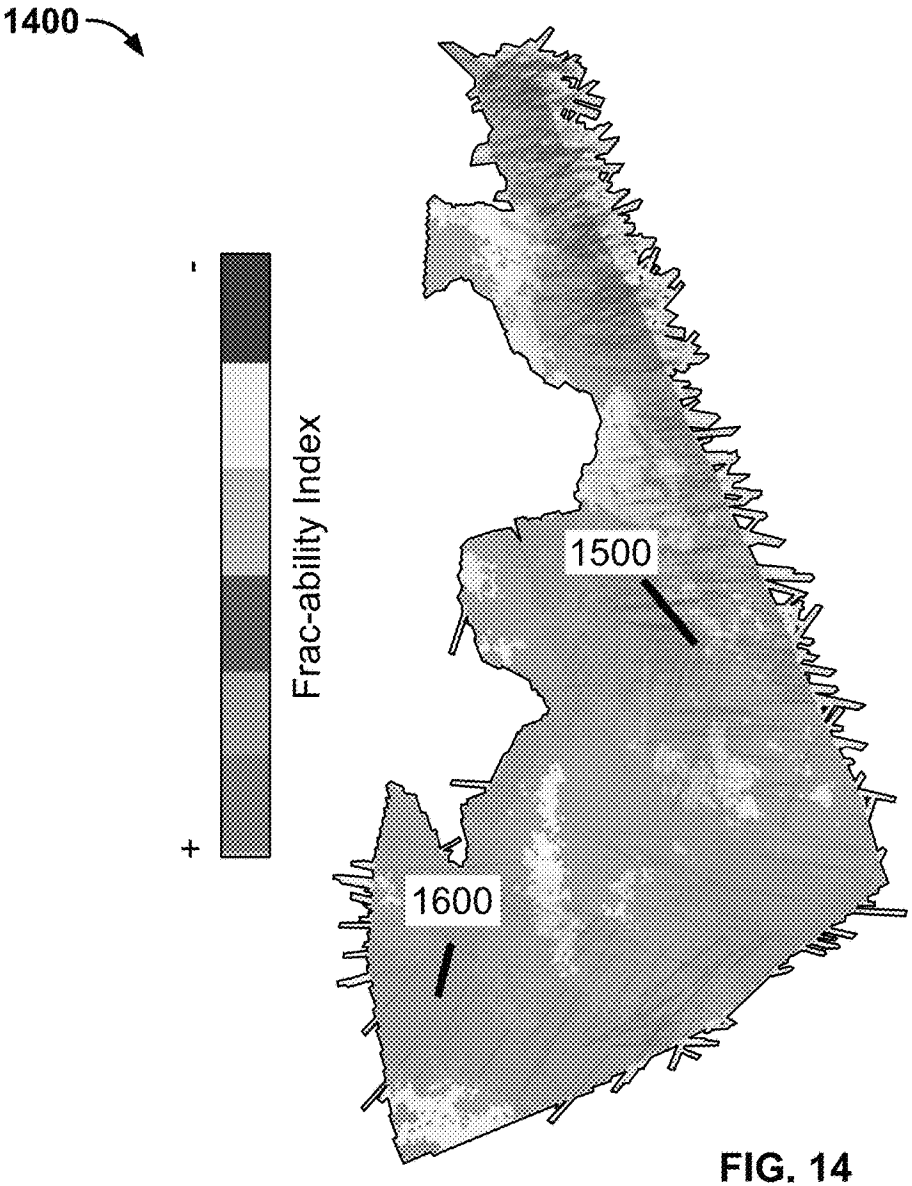
FIG. 14 shows an illustration of a 3D model of a subsurface region showing a fracability properties distribution and fluid-flow paths with results of hydraulic fracturing.

FIG. 14 shows an illustration of a 3D model 1400 of a subsurface region showing a fracability properties distribution and fluid-flow paths with results of hydraulic fracturing. FIG. 14 shows example locations of wells 1500 and 1600, associated with the data for FIGS. 15 and 16, respectively. The fracability index represents mechanical units within the reservoir with differential response to the stress/strain. The scale shows easy (+) areas for hydraulic fracturing to difficult (−) areas for hydraulic fracturing. The presence of fracture fluid-flow supports injectivity and in general improves hydraulic fracturing performance as shown by the difference between the well 1600 with low poor performance and well 1500 with high performance during the stimulation.

Figure 15:
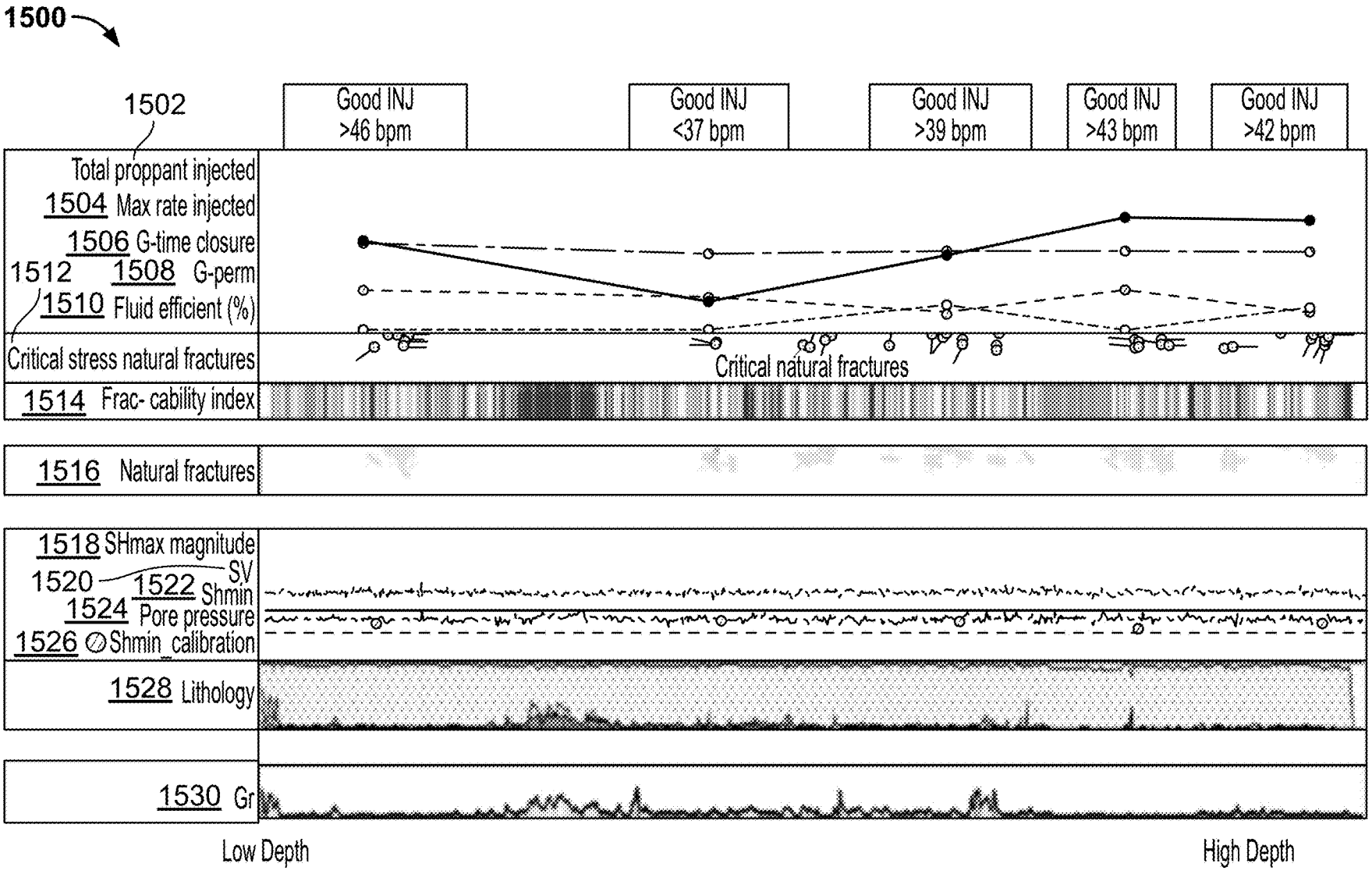
FIG. 15 shows results of hydraulic fracturing for the subsurface region of FIG. 14 at a first given location.

FIG. 15 shows results of hydraulic fracturing for the subsurface region of FIG. 14 at a first given well location 1500. Well location 1500 is in a favorable fracking location in the subsurface. The data associated with well 1500 include values for total proppant injected 1502, a max injection rate 1504, a G-time closure value 1506, a G-perm value 1508, a fluid efficiency percentage (1510), critical stress natural fracture prevalence 1512, fracture capability index values 1514, natural fracture presence 1516, max shear stress magnitude 1518, SV values 1520, minimum shear stress values 1522, pore pressure 1524, a calibrated minimum stress 1526, lithology values, 1528, and Gr values 1530. These values are determined as described throughout this specification and can be used as inputs for the machine learning model to generate model 1400.

Figure 16:
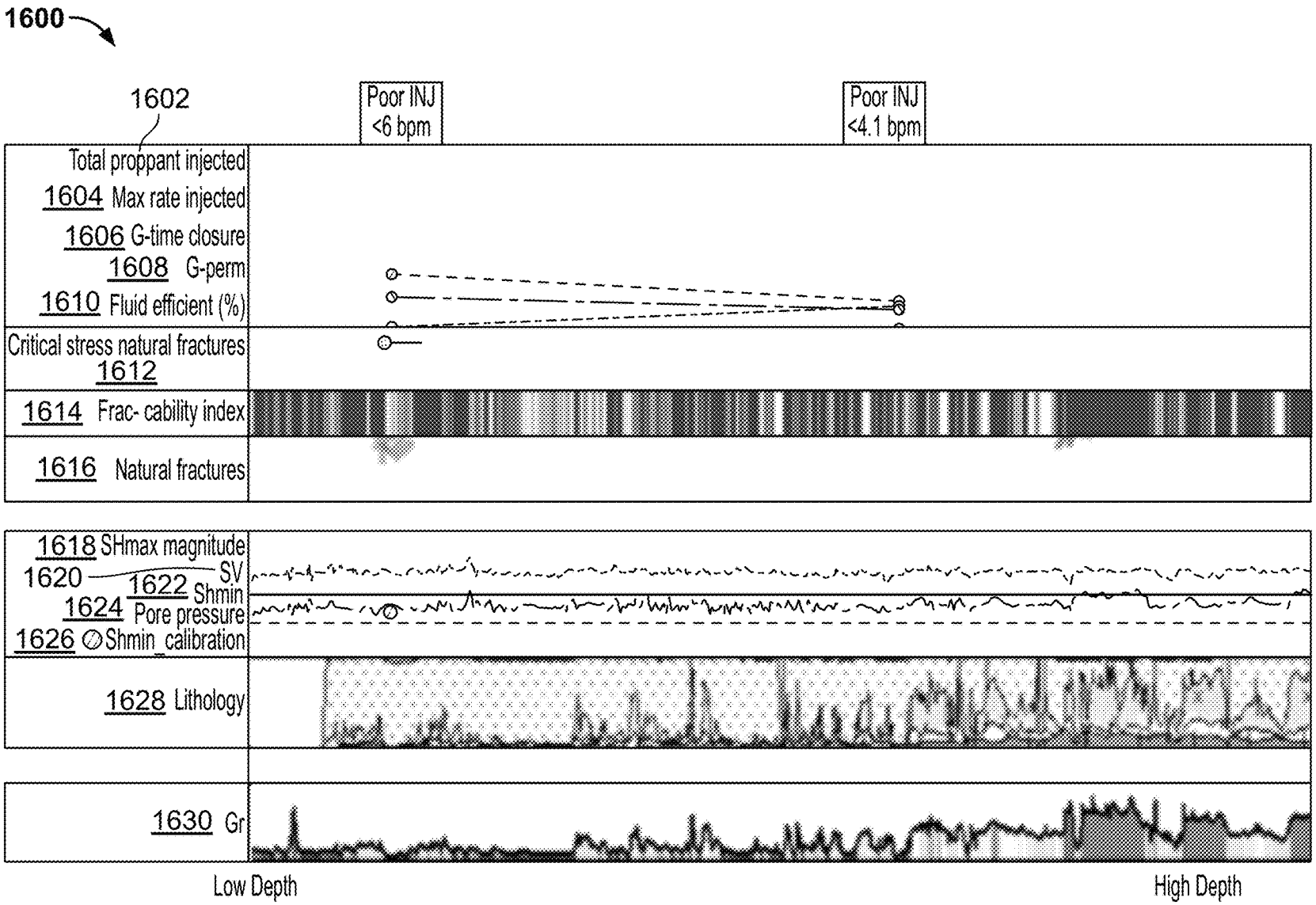
FIG. 16 shows results of hydraulic fracturing for the subsurface region of FIG. 14 at a second given location.

FIG. 16 shows results of hydraulic fracturing for the subsurface region of FIG. 14 at a second given well location 1600. Well location 1600 is in an unfavorable fracking location in the subsurface. The data associated with well 1600 include values for total proppant injected 1602, a max injection rate 1604, a G-time closure value 1606, a G-perm value 1608, a fluid efficiency percentage (1610), critical stress natural fracture prevalence 1612, fracture capability index values 1614, natural fracture presence 1616, max shear stress magnitude 1618, SV values 1620, minimum shear stress values 1622, pore pressure 1624, a calibrated minimum stress 1626, lithology values, 1628, and Gr values 1630. These values are determined as described throughout this specification and can be used as inputs for the machine learning model to generate model 1400.

Figure 17A:
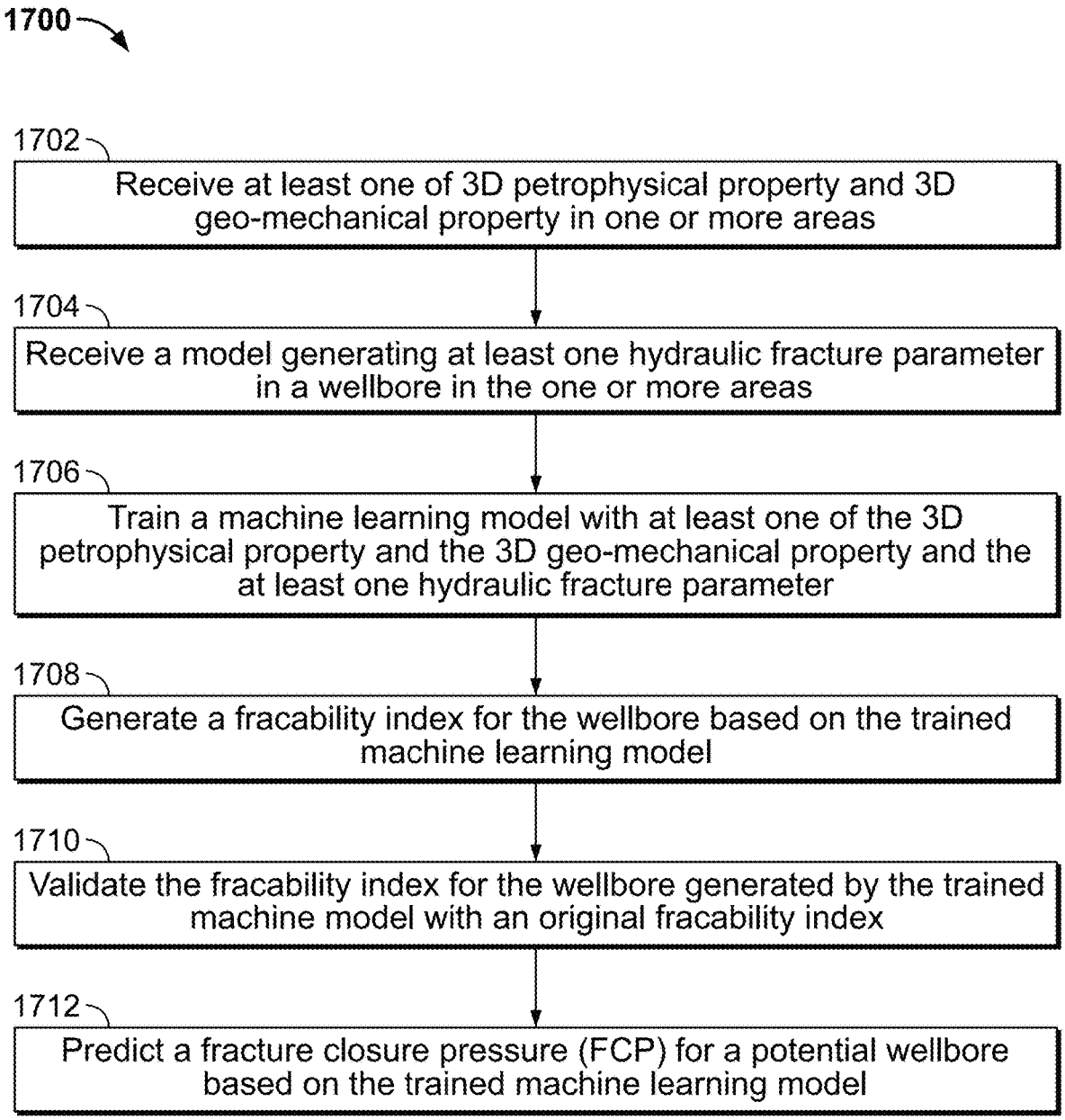
FIG. 17A is a flowchart of an example of a method for identifying fracable area, according to some implementations of the present disclosure.

FIG. 17A is a flowchart of an example of a method 1700 for identifying fracable area, according to some implementations of the present disclosure. For clarity of presentation, the description that follows generally describes method 1700 in the context of the other figures in this description. However, it will be understood that method 1700 can be performed, for example, by any suitable system, environment, software, and hardware, or a combination of systems, environments, software, and hardware, as appropriate. In some implementations, various steps of method 1700 can be run in parallel, in combination, in loops, or in any order.

At 1702, the method 1700 starts with a step of receiving at least one of 3D petrophysical property and 3D geo-mechanical property in one or more areas. In some implementations, the 3D petrophysical property includes porosity, permeability, petrophysical rock types. In some implementations, the 3D geo-mechanical property includes rock elastic properties, rock strength properties, stress regime profiles, wellbore stability, and brittleness. From 1702, the method 1700 proceeds to 1704.

At 1704, the method 1700 proceeds with a step of receiving a model generating at least one hydraulic fracture parameter in a wellbore in the one or more areas. In some implementations, the hydraulic fracture parameter includes fracture closure pressure and an injection rate. From 1704, the method 1700 proceeds to 1706.

At 1706, the method 1700 further proceeds with a step of training a machine learning model with at least one of the 3D petrophysical property and the 3D geo-mechanical property and the at least one hydraulic fracture parameter. From 1706, the method 1700 proceeds to 1708.

At 1708, the method 1700 further proceeds with a step of generating a fracability index for the wellbore based on the trained machine learning model. From 1708, the method 1700 proceeds to 1710.

At 1710, the method 1700 further proceeds with a step of validating the fracability index for the wellbore generated by the trained machine model with an original fracability index. In some implementations, the original fracability is generated based on at least one of the 3D petrophysical property and the 3D geo-mechanical property and the at least one hydraulic fracture parameter. From 1710, the method 1700 proceeds to 1712.

At 1712, the method 1700 further proceeds with a step of predicting a fracture closure pressure (FCP) for a potential wellbore based on the trained machine learning model. After 1712, the method 1700 can stop.

In some implementations, the method 1700 further includes receiving a fluid-flow path model, where the fluid-flow path model is constructed based on a fracture density index (FDI) of the wellbore, and generating a fracture closure pressure (FCP) for the wellbore based on the trained machine learning model.

In some implementations, the method 1700 further includes predicting a fracture closure pressure (FCP) for a potential wellbore based on a 3D mechanical earth model. In some implementations, the 3D mechanical earth model is built based on the trained machine learning model and at least one of well logs and mechanical test data in the one or more areas.

Figure 17B:
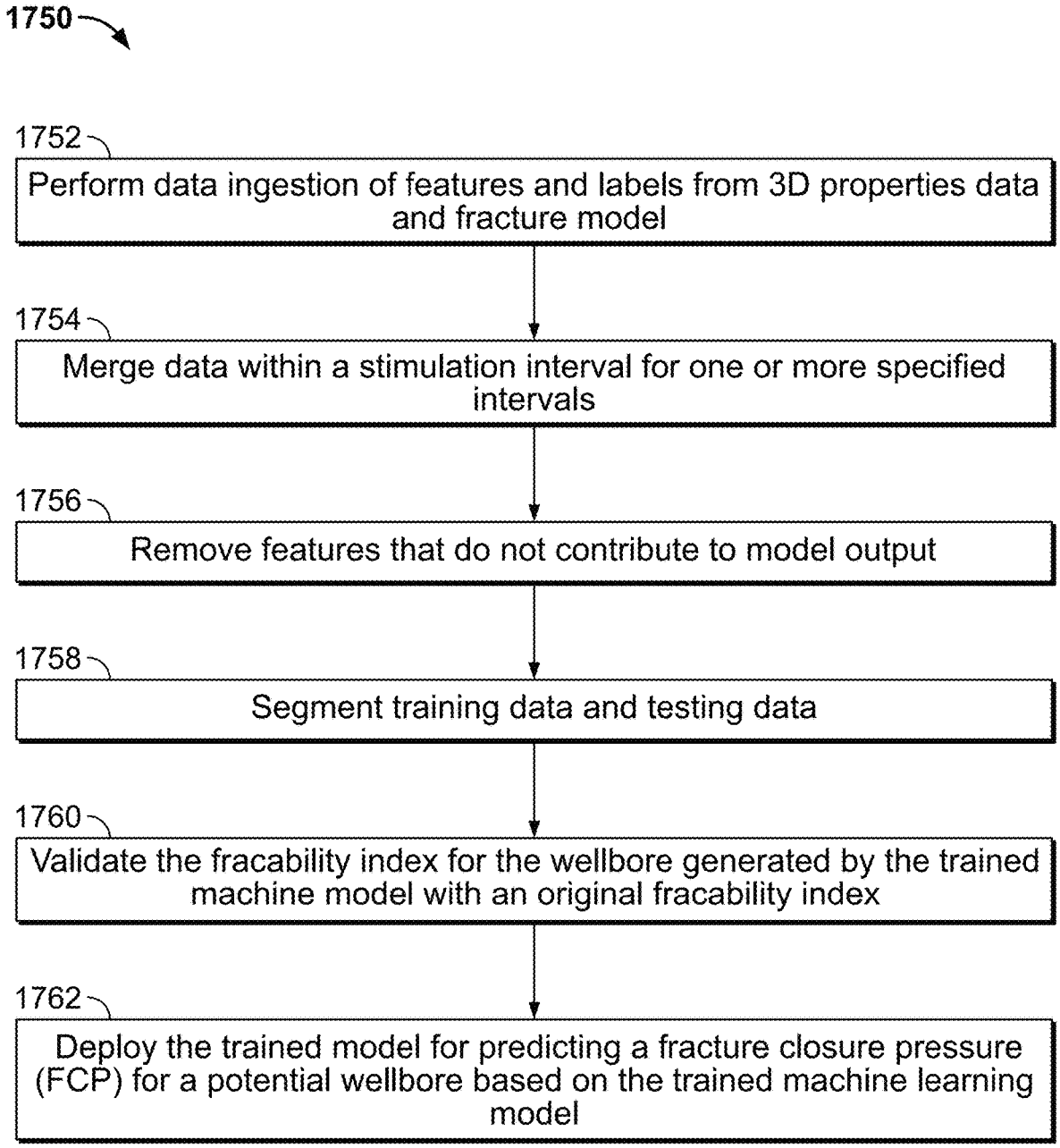
FIG. 17B is a flowchart of an example of a method for identifying fracable area, according to some implementations of the present disclosure.

FIG. 17B is a flowchart of an example of a method 1750 for identifying fracable area, according to some implementations of the present disclosure. For clarity of presentation, the description that follows generally describes method 1750 in the context of the other figures in this description. However, it will be understood that method 1750 can be performed, for example, by any suitable system, environment, software, and hardware, or a combination of systems, environments, software, and hardware, as appropriate. In some implementations, various steps of method 1750 can be run in parallel, in combination, in loops, or in any order.

The data processing system is configured to perform (1752) data ingestion of features and labels from 3D properties data and fracture model. The data processing system is configured to merge (1754) data within a stimulation interval for one or more specified intervals. The data processing system is configured to remove (1756) features that do not contribute to model output. The data processing system is configured to segment (1758) training data and testing data. The data processing system is configured to validate (1760) the fracability index for the wellbore generated by the trained machine model with an original fracability index. The data processing system is configured to deploy (1762) the trained model for predicting a fracture closure pressure (FCP) for a potential wellbore based on the trained machine learning model.

Figure 18:
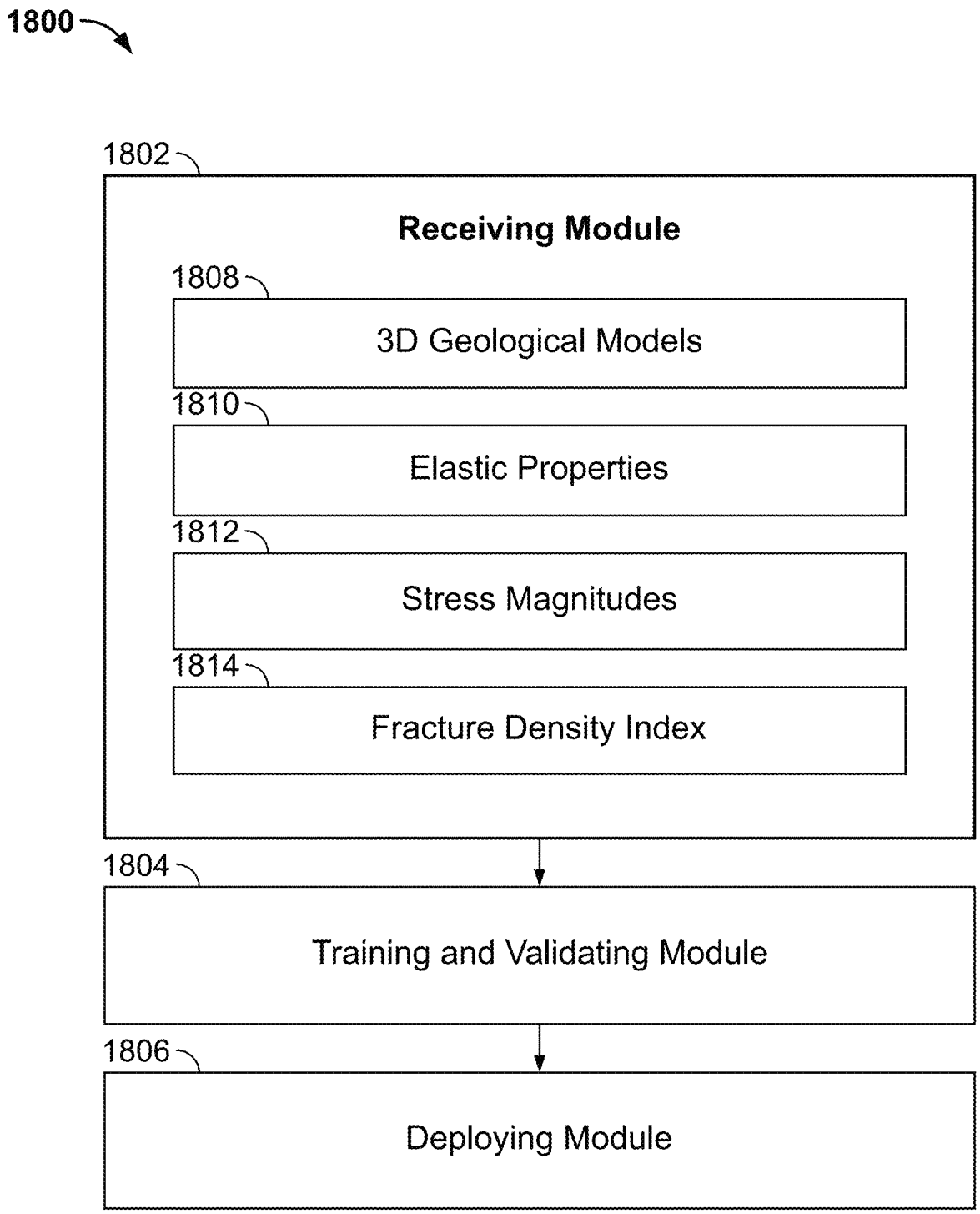
FIG. 18 is a is a flow diagram showing a process for training a model for determining a 3D fracability index for identifying fracable areas in a subsurface region.

FIG. 18 is a block diagram of an example system 1800 used to perform described algorithms, methods, functions, processes, flows, and procedures described in the present disclosure, according to some implementations of the present disclosure. The system 1800 includes a receiving module 1802, a training and validating module 1804, and a deploying module 1806.

The data processed by the training and validation module 1804 include the 3D geological models 1808, the elastic properties 1810, the stress magnitudes 1812, and the fracture density index values 1814. These correspond to the data 102, 104, 106, and 108, respectively, of FIG. 1.

Figure 19:
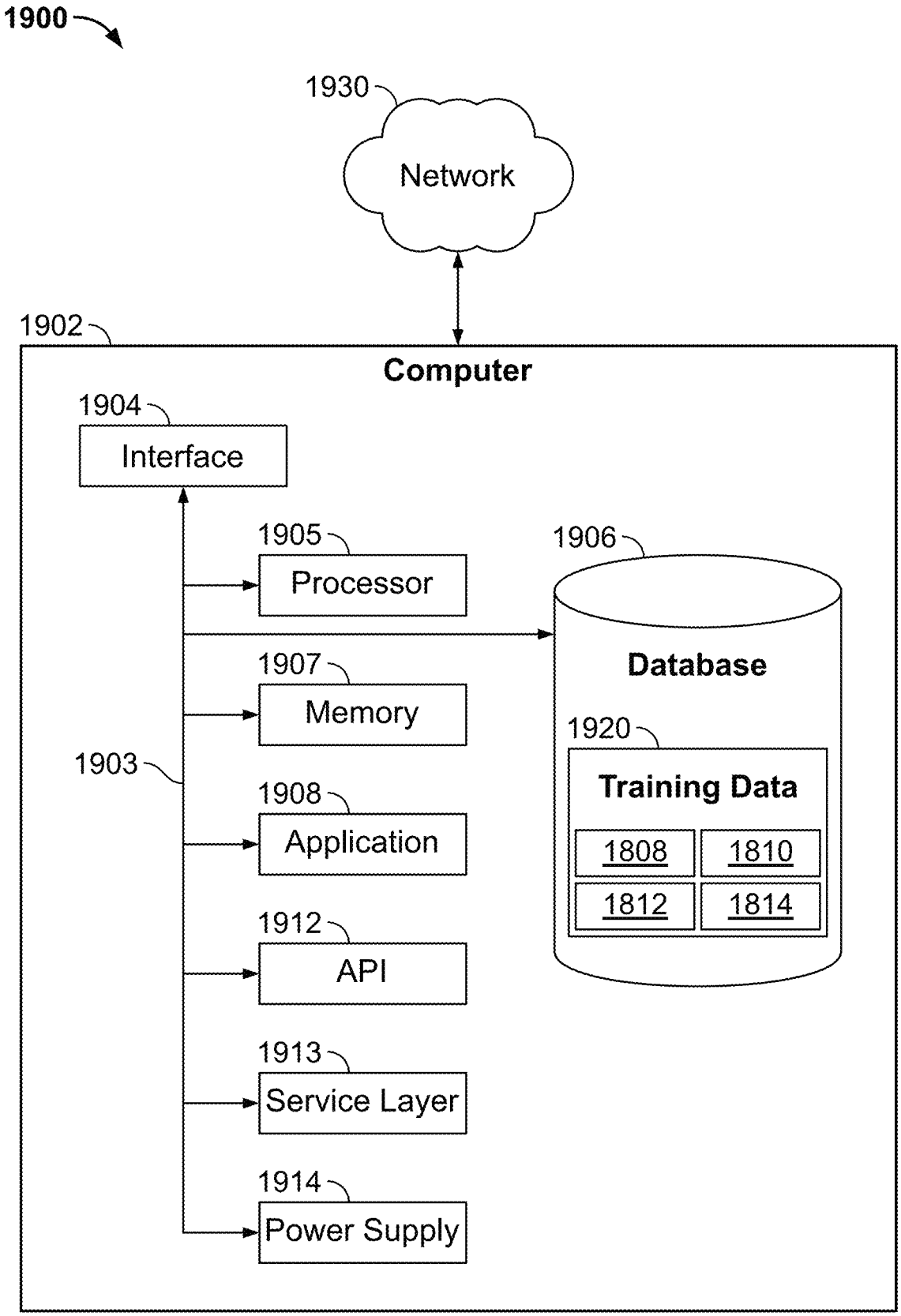
FIG. 19 is a block diagram illustrating an example computer system used to provide computational functionalities associated with described algorithms, methods, functions, processes, flows, and procedures as described in the present disclosure, according to some implementations of the present disclosure.

FIG. 19 is a block diagram of an example computer system 1900 used to provide computational functionalities associated with described algorithms, methods, functions, processes, flows, and procedures described in the present disclosure, according to some implementations of the present disclosure. The illustrated computer 1902 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1902 can include input devices such as keypads, keyboards, and touch screens that can accept user information. Also, the computer 1902 can include output devices that can convey information associated with the operation of the computer 1902. The information can include digital data, visual data, audio information, or a combination of information. The information can be presented in a graphical user interface (UI) (or GUI).

The computer 1902 can serve in a role as a client, a network component, a server, a database, a persistency, or components of a computer system for performing the subject matter described in the present disclosure. The illustrated computer 1902 is communicably coupled with a network 1930. In some implementations, one or more components of the computer 1902 can be configured to operate within different environments, including cloud-computing-based environments, local environments, global environments, and combinations of environments.

At a top level, the computer 1902 is an electronic computing device operable to receive, transmit, process, store, and manage data and information associated with the described subject matter. According to some implementations, the computer 1902 can also include, or be communicably coupled with, an application server, an email server, a web server, a caching server, a streaming data server, or a combination of servers.

The computer 1902 can receive requests over network 1930 from a client application (for example, executing on another computer 1902). The computer 1902 can respond to the received requests by processing the received requests using software applications. Requests can also be sent to the computer 1902 from internal users (for example, from a command console), external (or third) parties, automated applications, entities, individuals, systems, and computers.

Each of the components of the computer 1902 can communicate using a system bus 1903. In some implementations, any or all of the components of the computer 1902, including hardware or software components, can interface with each other or the interface 1904 (or a combination of both) over the system bus 1903. Interfaces can use an application programming interface (API) 1912, a service layer 1913, or a combination of the API 1912 and service layer 1913. The API 1912 can include specifications for routines, data structures, and object classes. The API 1912 can be either computer-language independent or dependent. The API 1912 can refer to a complete interface, a single function, or a set of APIs.

The service layer 1913 can provide software services to the computer 1902 and other components (whether illustrated or not) that are communicably coupled to the computer 1902. The functionality of the computer 1902 can be accessible for all service consumers using this service layer. Software services, such as those provided by the service layer 1913, can provide reusable, defined functionalities through a defined interface. For example, the interface can be software written in JAVA, C++, or a language providing data in extensible markup language (XML) format. While illustrated as an integrated component of the computer 1902, in alternative implementations, the API 1912 or the service layer 1913 can be stand-alone components in relation to other components of the computer 1902 and other components communicably coupled to the computer 1902. Moreover, any or all parts of the API 1912 or the service layer 1913 can be implemented as child or sub-modules of another software module, enterprise application, or hardware module without departing from the scope of the present disclosure.

The computer 1902 includes an interface 1904. Although illustrated as a single interface 1904 in FIG. 19, two or more interfaces 1904 can be used according to particular needs, desires, or particular implementations of the computer 1902 and the described functionality. The interface 1904 can be used by the computer 1902 for communicating with other systems that are connected to the network 1930 (whether illustrated or not) in a distributed environment. Generally, the interface 1904 can include, or be implemented using, logic encoded in software or hardware (or a combination of software and hardware) operable to communicate with the network 1930. More specifically, the interface 1904 can include software supporting one or more communication protocols associated with communications. As such, the network 1930 or the interface's hardware can be operable to communicate physical signals within and outside of the illustrated computer 1902.

The computer 1902 includes a processor 1905. Although illustrated as a single processor 1905 in FIG. 19, two or more processors 1905 can be used according to particular needs, desires, or particular implementations of the computer 1902 and the described functionality. Generally, the processor 1905 can execute instructions and can manipulate data to perform the operations of the computer 1902, including operations using algorithms, methods, functions, processes, flows, and procedures as described in the present disclosure.

The computer 1902 also includes a database 1906 that can hold data for the computer 1902 and other components connected to the network 1930 (whether illustrated or not). For example, database 1906 can be an in-memory, conventional, or a database storing data consistent with the present disclosure. In some implementations, database 1906 can be a combination of two or more different database types (for example, hybrid in-memory and conventional databases) according to particular needs, desires, or particular implementations of the computer 1902 and the described functionality. Although illustrated as a single database 1906 in FIG. 19, two or more databases (of the same, different, or combination of types) can be used according to particular needs, desires, or particular implementations of the computer 1902 and the described functionality. While database 1906 is illustrated as an internal component of the computer 1902, in alternative implementations, database 1906 can be external to the computer 1902.

The computer 1902 also includes a memory 1907 that can hold data for the computer 1902 or a combination of components connected to the network 1930 (whether illustrated or not). Memory 1907 can store any data consistent with the present disclosure. In some implementations, memory 1907 can be a combination of two or more different types of memory (for example, a combination of semiconductor and magnetic storage) according to particular needs, desires, or particular implementations of the computer 1902 and the described functionality. Although illustrated as a single memory 1907 in FIG. 19, two or more memories 1907 (of the same, different, or combination of types) can be used according to particular needs, desires, or particular implementations of the computer 1902 and the described functionality. While memory 1907 is illustrated as an internal component of the computer 1902, in alternative implementations, memory 1907 can be external to the computer 1902.

The application 1908 can be an algorithmic software engine providing functionality according to particular needs, desires, or particular implementations of the computer 1902 and the described functionality. For example, application 1908 can serve as one or more components, modules, or applications. Further, although illustrated as a single application 1908, the application 1908 can be implemented as multiple applications 1908 on the computer 1902. In addition, although illustrated as internal to the computer 1902, in alternative implementations, the application 1908 can be external to the computer 1902.

The computer 1902 can also include a power supply 1914. The power supply 1914 can include a rechargeable or non-rechargeable battery that can be configured to be either user- or non-user-replaceable. In some implementations, the power supply 1914 can include power-conversion and management circuits, including recharging, standby, and power management functionalities. In some implementations, the power-supply 1914 can include a power plug to allow the computer 1902 to be plugged into a wall socket or a power source to, for example, power the computer 1902 or recharge a rechargeable battery.

There can be any number of computers 1902 associated with, or external to, a computer system containing computer 1902, with each computer 1902 communicating over network 1930. Further, the terms "client," "user," and other appropriate terminology can be used interchangeably, as appropriate, without departing from the scope of the present disclosure. Moreover, the present disclosure contemplates that many users can use one computer 1902 and one user can use multiple computers 1902. Training data 1920 include 3D geological models 1808, the elastic properties 1810, the stress magnitudes 1812, and the fracture density index values 1814, previously described.

Described implementations of the subject matter can include one or more features, alone or in combination.

For example, in a first implementation, a computer-implemented method, including: receiving at least one of 3D petrophysical property and 3D geo-mechanical property in one or more areas, receiving a model generating at least one hydraulic fracture parameter in a wellbore in the one or more areas, training a machine learning model with at least one of the 3D petrophysical property and the 3D geo-mechanical property and the at least one hydraulic fracture parameter, and generating a fracability index for the wellbore based on the trained machine learning model.

The foregoing and other described implementations can each, optionally, include one or more of the following features:

A first feature, combinable with any of the following features, the method further including: receiving a fluid-flow path model, where the fluid-flow path model is constructed based on a fracture density index (FDI) of the wellbore, and generating a fracture closure pressure (FCP) for the wellbore based on the trained machine learning model.

A second feature, combinable with any of the previous or following features, the method further including: validating the fracability index for the wellbore generated by the trained machine model with an original fracability index, where the original fracability is generated based on at least one of the 3D petrophysical property and the 3D geo-mechanical property and the at least one hydraulic fracture parameter, and predicting a fracture closure pressure (FCP) for a potential wellbore based on the trained machine learning model.

A third feature, combinable with any of the previous or following features, the method further including: predicting a fracture closure pressure (FCP) for a potential wellbore based on a 3D mechanical earth model, where the 3D mechanical earth model is built based on the trained machine learning model and at least one of well logs and mechanical test data in the one or more areas.

A fourth feature, combinable with any of the previous or following features, where the 3D petrophysical property includes porosity, permeability, and petrophysical rock types.

A fifth feature, combinable with any of the previous or following features, where the 3D geo-mechanical property includes rock elastic properties, rock strength properties, stress regime profiles, wellbore stability, and brittleness.

A sixth feature, combinable with any of the previous or following features, where the hydraulic fracture parameter includes fracture closure pressure and an injection rate.

In a second implementation, a non-transitory, computer-readable medium storing one or more instructions executable by a computer system to perform operations including: receiving at least one of 3D petrophysical property and 3D geo-mechanical property in one or more areas, receiving a model generating at least one hydraulic fracture parameter in a wellbore in the one or more areas, training a machine learning model with at least one of the 3D petrophysical property and the 3D geo-mechanical property and the at least one hydraulic fracture parameter, and generating a fracability index for the wellbore based on the trained machine learning model.

The foregoing and other described implementations can each, optionally, include one or more of the following features:

A first feature, combinable with any of the following features, the operations further including: receiving a fluid-flow path model, where the fluid-flow path model is constructed based on a fracture density index (FDI) of the wellbore, and generating a fracture closure pressure (FCP) for the wellbore based on the trained machine learning model.

A second feature, combinable with any of the previous or following features, the operations further including: validating the fracability index for the wellbore generated by the trained machine model with an original fracability index, where the original fracability is generated based on at least one of the 3D petrophysical property and the 3D geo-mechanical property and the at least one hydraulic fracture parameter, and predicting a fracture closure pressure (FCP) for a potential wellbore based on the trained machine learning model.

A third feature, combinable with any of the previous or following features, the operations further including: predicting a fracture closure pressure (FCP) for a potential wellbore based on a 3D mechanical earth model, where the 3D mechanical earth model is built based on the trained machine learning model and at least one of well logs and mechanical test data in the one or more areas.

A fourth feature, combinable with any of the previous or following features, where the 3D petrophysical property includes porosity, permeability, and petrophysical rock types.

A fifth feature, combinable with any of the previous or following features, where the 3D geo-mechanical property includes rock elastic properties, rock strength properties, stress regime profiles, wellbore stability, and brittleness.

A sixth feature, combinable with any of the previous or following features, where the hydraulic fracture parameter includes fracture closure pressure and an injection rate.

In a third implementation, a computer-implemented system, including one or more processors and a non-transitory computer-readable storage medium coupled to the one or more processors and storing programming instructions for execution by the one or more processors, the programming instructions instructing the one or more processors to perform operations including: receiving at least one of 3D petrophysical property and 3D geo-mechanical property in one or more areas, receiving a model generating at least one hydraulic fracture parameter in a wellbore in the one or more areas, training a machine learning model with at least one of the 3D petrophysical property and the 3D geo-mechanical property and the at least one hydraulic fracture parameter, and generating a fracability index for the wellbore based on the trained machine learning model.

The foregoing and other described implementations can each, optionally, include one or more of the following features:

A first feature, combinable with any of the following features, the operations further including: receiving a fluid-flow path model, where the fluid-flow path model is constructed based on a fracture density index (FDI) of the wellbore, and generating a fracture closure pressure (FCP) for the wellbore based on the trained machine learning model.

A second feature, combinable with any of the previous or following features, the operations further including: validating the fracability index for the wellbore generated by the trained machine model with an original fracability index, where the original fracability is generated based on at least one of the 3D petrophysical property and the 3D geo-mechanical property and the at least one hydraulic fracture parameter, and predicting a fracture closure pressure (FCP) for a potential wellbore based on the trained machine learning model.

A third feature, combinable with any of the previous or following features, the operations further including: predicting a fracture closure pressure (FCP) for a potential wellbore based on a 3D mechanical earth model, where the 3D mechanical earth model is built based on the trained machine learning model and at least one of well logs and mechanical test data in the one or more areas.

A fourth feature, combinable with any of the previous or following features, where the 3D petrophysical property includes porosity, permeability, and petrophysical rock types.

A fifth feature, combinable with any of the previous or following features, where the 3D geo-mechanical property includes rock elastic properties, rock strength properties, stress regime profiles, wellbore stability, and brittleness.

A sixth feature, combinable with any of the previous or following features, where the hydraulic fracture parameter includes fracture closure pressure and an injection rate.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/-R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented method for identifying fracable areas of a subsurface region including an unfractured wellbore, comprising:

receiving data comprising a first value representing a three-dimensional (3D) petrophysical property for a given subsurface region including a fractured wellbore, a second value representing a 3D geo-mechanical property for the given subsurface region including the fractured wellbore, or both the first value and the second value;

receiving a geological model that includes a value for at least one hydraulic fracture parameter that is associated with the fractured wellbore in the subsurface region;

training a machine learning model with at least one of the first value and the second value and with the value of the at least one hydraulic fracture parameter; and receiving a fluid-flow path model, wherein the fluid-flow path model is constructed based on a fracture density index (FDI) of the wellbore;

applying the machine learning model to data representing the at least one of the 3D petrophysical property and the 3D geo-mechanical property and the at least one hydraulic fracture parameter for the subsurface region comprising an unfractured wellbore;

generating a fracture closure pressure (FCP) for the wellbore based on the trained machine learning model;

generating a fracability index for the unfractured wellbore based on the trained machine learning model; and based on the fracability index, fracturing the unfractured wellbore.

2. The computer-implemented method of claim 1, further comprising:

validating the fracability index for the wellbore generated by the trained machine model with an original fracability index, wherein the original fracability is generated based on at least one of the 3D petrophysical property and the 3D geo-mechanical property and the at least one hydraulic fracture parameter; and predicting a fracture closure pressure (FCP) for a potential wellbore based on the trained machine learning model.

3. The computer-implemented method of claim 1, further comprising:

predicting a fracture closure pressure (FCP) for a potential wellbore based on a 3D mechanical earth model, wherein the 3D mechanical earth model is built based on the trained machine learning model and at least one of well logs and mechanical test data for wells in the subsurface region.

4. The computer-implemented method of claim 1, wherein the 3D petrophysical property comprises porosity, permeability, and petrophysical rock types.

5. The computer-implemented method of claim 1, wherein the 3D geo-mechanical property comprises rock elastic properties, rock strength properties, stress regime profiles, wellbore stability, and brittleness.

6. The computer-implemented method of claim 1, wherein the at least one hydraulic fracture parameter comprises fracture closure pressure and an injection rate.

7. A non-transitory, computer-readable medium storing one or more instructions executable by a computer system to perform operations comprising:

receiving data comprising a first value representing a three-dimensional (3D) petrophysical property for a given subsurface region including a fractured wellbore, a second value representing a 3D geo-mechanical property for the given subsurface region including the fractured wellbore, or both the first value and the second value;

receiving a geological model that includes a value for at least one hydraulic fracture parameter that is associated with the fractured wellbore in the subsurface region;

training a machine learning model with at least one of the first value and the second value and with the value of the at least one hydraulic fracture parameter;

receiving a fluid-flow path model, wherein the fluid-flow path model is constructed based on a fracture density index (FDI) of the wellbore;

applying the machine learning model to data representing the at least one of the 3D petrophysical property and the 3D geo-mechanical property and the at least one hydraulic fracture parameter for the subsurface region comprising an unfractured wellbore;

generating a fracture closure pressure (FCP) for the wellbore based on the trained machine learning model;

generating a fracability index for the unfractured wellbore based on the trained machine learning model; and based on the fracability index, fracturing the unfractured wellbore.

8. The non-transitory, computer-readable medium of claim 7, wherein the operations further comprises:

validating the fracability index for the wellbore generated by the trained machine model with an original fracability index, wherein the original fracability is generated based on at least one of the 3D petrophysical property and the 3D geo-mechanical property and the at least one hydraulic fracture parameter; and predicting a fracture closure pressure (FCP) for a potential wellbore based on the trained machine learning model.

9. The non-transitory, computer-readable medium of claim 7, wherein the operations further comprise:

predicting a fracture closure pressure (FCP) for a potential wellbore based on a 3D mechanical earth model, wherein the 3D mechanical earth model is built based on the trained machine learning model and at least one of well logs and mechanical test data in the subsurface region.

10. The non-transitory, computer-readable medium of claim 7, wherein the 3D petrophysical property comprises porosity, permeability, and petrophysical rock types.

11. The non-transitory, computer-readable medium of claim 7, wherein the 3D geo-mechanical property comprises rock elastic properties, rock strength properties, stress regime profiles, wellbore stability, and brittleness.

12. The non-transitory, computer-readable medium of claim 7, wherein the at least one hydraulic fracture parameter comprises fracture closure pressure and an injection rate.

13. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

receiving data comprising a first value representing a three-dimensional (3D) petrophysical property for a given subsurface region including a fractured wellbore, a second value representing a 3D geo-mechanical property for the given subsurface region including the fractured wellbore, or both the first value and the second value;

receiving a geological model that includes a value for at least one hydraulic fracture parameter that is associated with the fractured wellbore in the subsurface region;

training a machine learning model with at least one of the first value and the second value and with the value of the at least one hydraulic fracture parameter;

receiving a fluid-flow path model, wherein the fluid-flow path model is constructed based on a fracture density index (FDI) of the wellbore;

applying the machine learning model to data representing the at least one of the 3D petrophysical property and the 3D geo-mechanical property and the at least one hydraulic fracture parameter for the subsurface region comprising an unfractured wellbore;

generating a fracture closure pressure (FCP) for the wellbore based on the trained machine learning model;

generating a fracability index for the unfractured wellbore based on the trained machine learning model; and based on the fracability index, fracturing the unfractured wellbore.

14. The computer-implemented system of claim 13, wherein the operations further comprise:

validating the fracability index for the wellbore generated by the trained machine model with an original fracability index, wherein the original fracability is generated based on at least one of the 3D petrophysical property and the 3D geo-mechanical property and the at least one hydraulic fracture parameter; and predicting a fracture closure pressure (FCP) for a potential wellbore based on the trained machine learning model.

15. The computer-implemented system of claim 13, wherein the operations further comprise:

predicting a fracture closure pressure (FCP) for a potential wellbore based on a 3D mechanical earth model, wherein the 3D mechanical earth model is built based on the trained machine learning model and at least one of well logs and mechanical test data in the subsurface region.

16. The computer-implemented system of claim 13, wherein the 3D petrophysical property comprises porosity, permeability, and petrophysical rock types.

17. The computer-implemented system of claim 13, wherein the 3D geo-mechanical property comprises rock elastic properties, rock strength properties, stress regime profiles, wellbore stability, and brittleness.

* * * * *